US006764153B2

(12) United States Patent
Tanaka

(10) Patent No.: US 6,764,153 B2
(45) Date of Patent: Jul. 20, 2004

(54) LIQUID EJECTING APPARATUS

(75) Inventor: Ryoichi Tanaka, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 10/350,321

(22) Filed: Jan. 24, 2003

(65) Prior Publication Data

US 2004/0075705 A1 Apr. 22, 2004

(30) Foreign Application Priority Data

Jan. 24, 2002 (JP) ..... 2002-015939
Jan. 23, 2003 (JP) ..... 2003-014498

(51) Int. Cl.[7] ..... B41J 29/38
(52) U.S. Cl. ..... 347/10; 347/9
(58) Field of Search ..... 347/9, 10, 11

(56) References Cited

U.S. PATENT DOCUMENTS 6,302,508 B1 10/2001 Asauchi et al.
6,328,395 B1 * 12/2001 Kitahara et al. ..... 347/9

FOREIGN PATENT DOCUMENTS

EP 0 596 530 A2 * 5/1994 ..... B41J/2/025
JP 10-56571 A 2/1998
JP 2000-225718 A 8/2000
JP 2001-162840 A 6/2001
JP 2002-292848 A 10/2002

* cited by examiner

*Primary Examiner*—Stephen D. Meier
*Assistant Examiner*—Alfred Dudding
(74) *Attorney, Agent, or Firm*—Sughrue Mion, PLLC

(57) ABSTRACT

A liquid ejecting apparatus of the invention includes: a head having a nozzle, a main scanning unit that causes the head member to move in a main scanning direction relatively to a recording medium, a pressure-changing unit that causes pressure of ink in the nozzle to change, and a level-data setting unit that sets a selected level data from a plurality of level data based on each of ejecting data forming a row corresponding to a main scanning movement. The level-data setting unit is adapted to set a selected level data of relatively high density based on each of the ejecting-sequential data, to set a selected level data of relatively low density based on the anterior edge data, and to set a selected level data of relatively low density based on the posterior edge data.

26 Claims, 17 Drawing Sheets

LIQUID EJECTING APPARATUS

FIELD OF THE INVENTION

This invention relates to a liquid ejecting apparatus for ejecting a drop of liquid from a nozzle. In particular, this invention is related to a liquid ejecting apparatus for ejecting a plurality of drops of liquid from a nozzle wherein respective volumes of the plurality of drops of liquid may be different.

BACKGROUND OF THE INVENTION

In a ink-jetting recording apparatus such as an ink-jetting printer or an ink-jetting plotter (a kind of liquid ejecting apparatus), a recording head (head member) is caused to move in a main scanning direction, and a recording paper (a kind of printing-recording medium) is caused to move in a sub-scanning direction. In cooperation with those movements, a drop of ink can be ejected from a nozzle of the recording head onto the recording paper. Thus, an image (character) can be recorded on the recording paper. For example, the drop of ink can be ejected by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is ejected from the nozzle.

In such a recording apparatus, a driving signal consisting of a series of a plurality of driving-pulses is generated. On the other hand, printing data (ejecting data) including level (gradation) information can be transmitted to the recording head. Then, based on the transmitted printing data, only necessary one or more driving-pulses are selected from the driving signal and supplied to the piezoelectric vibrating member. Thus, a volume of the ink ejected from the nozzle may be changed based on the level information.

In detail, for example, in an ink-jetting printer used with four level data consisting of: printing data for no recording (level information 00), printing data for a small dot (level information 01), printing data for a middle dot (level information 10) and printing data for a large dot (level information 11), respective volumes of the ink corresponding to the respective level information may be ejected.

In order to achieve the above four-level recording, for example, a driving signal shown in FIG. 18 may be used. As shown in FIG. 18, the driving signal has a first pulse signal PAPS1 arranged in a term PAT1, a second pulse signal PAPS2 arranged in a term PAT2 and a third pulse signal PAPS3 arranged in a term PAT3, which are connected in a series manner. The driving signal is a pulse-row signal having a recording period PATA.

In the case, the first pulse signal PAPS1 is adapted to function as a first driving pulse PADP1. The second pulse signal PAPS2 is adapted to function as a second driving pulse PADP2. The third pulse signal PAPS3 is adapted to function as a third driving pulse PADP3.

The first driving pulse PADP1, the second driving pulse PADP2 and the third driving pulse PADP3 have a common wave-pattern (wave form). Each of them can eject a drop of the ink alone. That is, when each of the driving pulses is supplied to the piezoelectric vibrating member, a drop of the ink, whose volume corresponds to a small dot, is ejected from the nozzle.

In the case, as shown in FIG. 19, a level control can be achieved by increasing or decreasing the number of the driving pulses supplied to the piezo electric vibrating member. For example, when only one driving pulse is supplied to the piezoelectric vibrating member, a small dot recording is achieved. When only two driving pulses are supplied to the piezoelectric vibrating member, a middle dot recording is achieved. When the three driving pulses are supplied to the piezoelectric vibrating member, a large dot recording is achieved.

Prior to this invention, a Japanese Patent Application No. 2001-194025 has been filed. The invention disclosed in the specification thereof relates to a technique to eject ink in order to print an image on a printing medium.

When a line drawing such as a character or an illustration is printed by means of an ink-jetting printer, bleeding of the ink may be generated at a contour portion of the line drawing. Such bleeding of the ink may be caused because the ink ejected at the line-drawing area is not fully absorbed by the printing medium and hence forms an ink pool, and then the ink of the ink pool starts to flow toward another area wherein no ink dot is to be formed.

The object of the above invention is to restrain bleeding of ink at a contour portion, in a printing apparatus that ejects drops of the ink in order to print an image.

In a printing apparatus according to the above invention, a contour is extracted, and volumes of ink for dots formed in pixels adjacent to the contour are regularly reduced. Thus, bleeding of the ink can be restrained, particularly when a text is printed on a printing paper such as a normal paper whose capacity to absorb the ink is small.

The reduction of the volumes of ink may be conducted by culling dots or by forming smaller dots.

In addition, in the invention disclosed in the Japanese Patent Application No. 2001-194025, the manner of reducing the volumes of the ink is fixed for the pixels adjacent to the contour. For example, when the driving signal shown in FIG. 18 is used, a small dot is formed in each pixel adjacent to the contour. As shown in FIG. 19, the small dot is formed by selecting the central driving pulse.

Thus, for example, if a large alphabet "H" is printed, drops of the ink are ejected at edge portions as shown in FIG. 20.

However, the inventor has found that gap lines Gin FIG. 20 can be easily perceived by human eyes, unexpectedly. Especially, in a case wherein BK (black) ink is used, existence of the gap lines G may be desight (eyesore) extremely. In order to achieve printing with much higher quality, it may be effective to restrain the gap lines G from being generated.

SUMMARY OF THE INVENTION

The object of this invention is to solve the above problems, that is, to provide a liquid ejecting apparatus such as an ink-jet recording apparatus that can achieve an edge process to prevent bleeding of ink and that can restrain generation of a gap line perceived at an edge portion.

This invention is a liquid ejecting apparatus comprising: a head having a nozzle; a main scanning unit that causes the head member to move in a main scanning direction relatively to a recording medium; a pressure-changing unit that causes pressure of liquid in the nozzle to change; a level-data setting unit that sets a selected level data from a plurality of level data, based on each of ejecting data forming a row corresponding to a main scanning movement; a driving-signal generator that generates an ejecting-driving signal; a driving-pulse generator that generates a driving pulse based on the selected level data and the ejecting-driving signal; and a main controller that causes the pressure-changing unit to operate, based on the driving pulse; wherein the row of the ejecting data includes: ejecting-sequential data corresponding to a continuous area of level data of relatively high density, an anterior edge data preceding the continuous area, and a posterior edge data following the continuous area; the level-data setting unit is adapted to set a selected level data of relatively high density based on each of the ejecting-sequential data, to set a selected level data of relatively low density based on the anterior edge data, and to set a selected level data of relatively low density based on the posterior edge data.

According to the invention, setting of level data based on the anterior edge data and setting of level data based on the posterior edge data can be independently conducted. Thus, for example, the manner of ejecting the liquid based on the anterior edge data may be made different from the manner of ejecting the liquid based on the posterior edge data. Thus, it is possible to restrain generation of a gap line that can be perceived at an edge portion.

For example, the ejecting-driving signal is a periodical signal including a plurality of pulse-waves. In the case, for example, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse.

In a preferable concrete example, the plurality of level data include a first low-density level data and a second low-density level data; the level-data setting unit is adapted to set the first low-density level data based on the anterior edge data, and to set the second low-density level data based on the posterior edge data; and the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof. Then, the driving-pulse generator is adapted to generate, based on the ejecting-driving signal: a driving-pulse including only the second small-dot pulse-wave when the selected level data is the first low-density level data, and a driving-pulse including only the first small-dot pulse-wave when the selected level data is the second low-density level data.

According to the above feature, both the small drop of the liquid ejected based on the anterior edge data and the small drop of the liquid ejected based on the posterior edge data become closer to the continuous area. Thus, it is possible to much effectively restrain generation of a gap line that can be perceived at an edge portion.

In general, it is preferable that the small drop of the liquid ejected from the nozzle according to the first small-dot pulse-wave has the same volume as the small drop of the liquid ejected from the nozzle according to the second small-dot pulse-wave. In the case, in general, the first small-dot pulse-wave and the second small-dot pulse-wave have the same wave-pattern (wave form).

In addition, in the case, preferably, the plurality of level data further include a high-density level data, the level-data setting unit is adapted to set the high-density level data based on each of the ejecting-sequential data, and the driving-pulse generator is adapted to generate a driving-pulse including at least the third pulse-wave when the selected level data is the high-density level data, based on the ejecting-driving signal. For example, the driving-pulse generator is adapted to generate a driving-pulse including the first small-dot pulse-wave, the second small-dot pulse-wave and the third pulse-wave, when the selected level data is the high-density level data, based on the ejecting-driving signal. The third pulse-wave may have the same wave-pattern as the first small-dot pulse-wave and the second small-dot pulse-wave, or may have a different wave-pattern from those.

In addition, it is preferable that the liquid ejecting apparatus further comprises a sub scanning unit that causes the head member to move in a sub scanning direction perpendicular to the main scanning direction relatively to the recording medium. In the case, the row of the ejecting data may include a longitudinal edge data adjacent to the continuous area of level data of relatively high density in the sub scanning direction. Then, it is preferable that the level-data setting unit is adapted to set the first low-density level data or the second low-density level data based on the longitudinal edge data.

Concretely, for example, when only two longitudinal edge data are serial in the main scanning direction, the level-data setting unit is adapted to set the first low-density level data based on the former longitudinal edge data, and to set the second low-density level data based on the latter longitudinal edge data.

Alternatively, when an even number of longitudinal edge data are serial in the main scanning direction, the level-data setting unit is adapted to set the first low-density level data based on each of former half of the longitudinal edge data, and to set the second low-density level data based on each of latter half of the longitudinal edge data.

More preferably, the plurality of level data further include a zero level data that corresponds to non-ejecting of the liquid, the driving-pulse generator is adapted to generate a driving-pulse not including any pulse-wave that is for ejecting a drop of the liquid when the selected level data is the zero level data, based on the ejecting-driving signal, and the level-data setting unit is adapted to set the first low-density level data, the second low-density level data or the zero level data, based on the longitudinal edge data.

Concretely, for example, when only three longitudinal edge data are serial in the main scanning direction, the level-data setting unit is adapted to set the first low-density level data based on the former longitudinal edge data, to set the zero level data based on the central longitudinal edge data, and to set the second low-density level data based on the latter longitudinal edge data.

Alternatively, when an odd number of longitudinal edge data are serial in the main scanning direction, the level-data setting unit is adapted to set the zero level data based on the central longitudinal edge data, to set the first low-density level data based on each of former longitudinal edge data with respect to the central longitudinal edge data, and to set the second low-density level data based on each of latter longitudinal edge data with respect to the central longitudinal edge data.

Alternatively, when only two longitudinal edge data are serial in the main scanning direction, the level-data setting unit is adapted to select one from the former longitudinal edge data and the latter longitudinal edge data; if the level-data setting unit selects the former longitudinal edge data, the level-data setting unit is adapted to set the first low-density level data based on the former longitudinal edge data; if the level-data setting unit selects the latter longitudinal edge data, the level-data setting unit is adapted to set the second low-density level data based on the latter longitudinal edge data; and the level-data setting unit is adapted to set the zero level data based on the unselected one of the former longitudinal edge data and the latter longitudinal edge data.

Alternatively, when an even number of longitudinal edge data are serial in the main scanning direction, the level-data setting unit is adapted to select one from the central two of the longitudinal edge data; if the level-data setting unit selects the former longitudinal edge data from the central two longitudinal edge data, the level-data setting unit is adapted to set the first low-density level data based on the former longitudinal edge data; if the level-data setting unit selects the latter longitudinal edge data from the central two longitudinal edge data, the level-data setting unit is adapted to set the second low-density level data based on the latter longitudinal edge data; the level-data setting unit is adapted to set the zero level data based on the unselected one of the central two longitudinal edge data; and the level-data setting unit is adapted to set the first low-density level data based on each of former longitudinal edge data with respect to the central two longitudinal edge data, and to set the second low-density level data based on each of latter longitudinal edge data with respect to the central two longitudinal edge data.

In addition, this invention is a controlling unit for controlling a liquid ejecting apparatus including: a head having a nozzle, a main scanning unit that causes the head member to move in a main scanning direction relatively to a recording medium, and a pressure-changing unit that causes pressure of liquid in the nozzle to change, the controlling unit comprising: a level-data setting unit that sets a selected level data from a plurality of level data, based on each of ejecting data forming a row corresponding to a main scanning movement; a driving-signal generator that generates an ejecting-driving signal; a driving-pulse generator that generates a driving pulse based on the selected level data and the ejecting-driving signal; and a main controller that causes the pressure-changing unit to operate, based on the driving pulse; wherein the row of the ejecting data includes: ejecting-sequential data corresponding to a continuous area of level data of relatively high density, an anterior edge data preceding the continuous area, and a posterior edge data following the continuous area; the level-data setting unit is adapted to set a selected level data of relatively high density based on each of the ejecting-sequential data, to set a selected level data of relatively low density based on the anterior edge data, and to set a selected level data of relatively low density based on the posterior edge data.

The above controlling unit or respective components in the controlling unit can be materialized by a computer system.

A program for materializing the respective units or the respective means in the computer system, and a storage medium storing the program capable of being read by a computer, should be protected by the application as well.

The storage unit may be not only a substantial object such as a floppy disk or the like, but also a network for transmitting various signals.

BEST MODE FOR CARRYING OUT THE INVENTION

An embodiment of the invention will now be described with reference to drawings.

Figure 1:
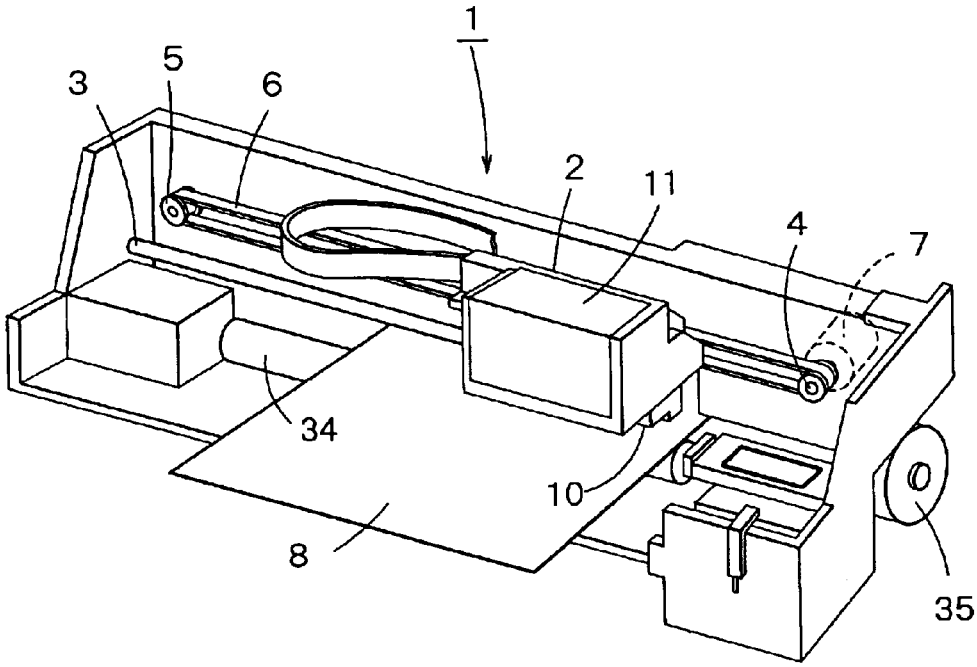
FIG. 1 is a schematic perspective view of an ink-jetting printer of an embodiment according to the invention.

FIG. 1 is a schematic perspective view of an ink-jetting printer 1 as a liquid ejecting apparatus of the embodiment. In the ink-jetting printer 1, a carriage 2 is movably mounted on a guide member 3. The carriage 2 is connected to a timing belt 6, which goes around a driving pulley 4 and a free pulley 5. The driving pulley 4 is connected to a rotational shaft of a pulse motor 7. Thus, the carriage 2 can be reciprocated along a direction of width of a recording paper 8 by driving the pulse motor 7 (main scanning).

A recording head (head member) 10 is mounted under the carriage 2 in such a manner that the recording head 10 faces to the recording paper 8.

Figure 2:
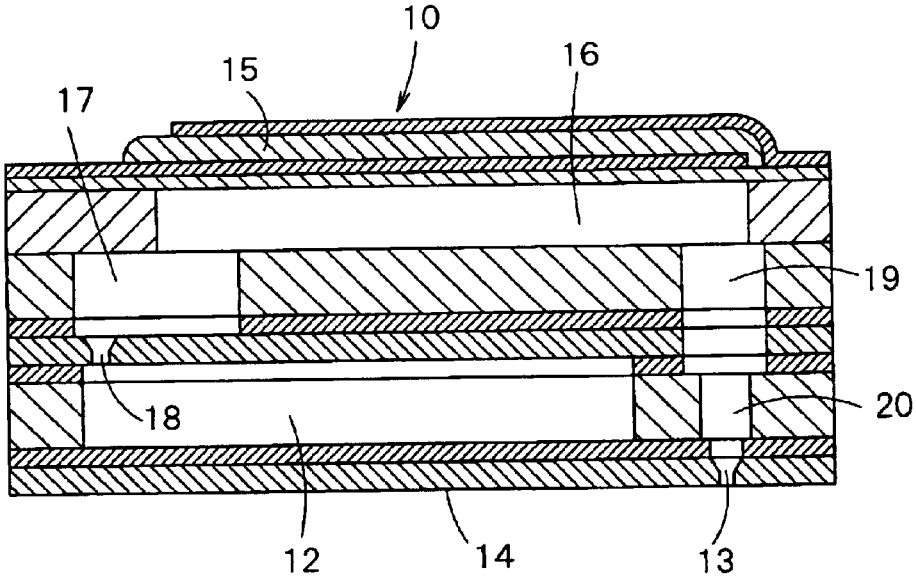
FIG. 2 is a sectional view for explaining an inside structure of a recording head.

As shown in FIG. 2, the recording head 10 mainly has: an ink chamber 12 to which ink is supplied from an ink cartridge 11 (see FIG. 1); a nozzle plate 14 provided with a plurality of (for example 64) nozzles 13 in a sub-scanning direction; and a plurality of pressure chambers 16 communicated with the plurality of nozzles 13, respectively. Each of the plurality of pressure chambers 16 is adapted to be caused to expand and contract by deformation of a piezoelectric vibrating member 15.

The ink chamber 12 and the plurality of pressure chambers 16 are communicated via a plurality of ink supplying holes 18 and a plurality of supply side communication holes 17, respectively. The plurality of pressure chambers 16 and the plurality of nozzles 13 are communicated via a plurality of first nozzle side communication holes 19 and a plurality of second nozzle side communication holes 20, respectively. Thus, for each of the plurality of nozzles 13, an ink passage is formed from the ink chamber 12 to each of the plurality of nozzles 13 via each of the plurality of pressure chambers 16.

The nozzle plate 14 in the embodiment is formed as an ink-repellent nozzle plate 14. The ink-repellent nozzle plate 14 has a uniformly formed ink-repellent film on a surface of a base plate. The ink-repellent nozzle plate 14 is provided with the plurality of nozzles 13, each of which is a through opening.

The nozzle 13 has a smaller diameter at an outside surface of the nozzle plate 14 which faces to the recording paper 8, and a larger diameter at the side of the corresponding second nozzle communication hole 20, that is, at the reverse surface of the nozzle plate 14. Thus, an inside surface of the nozzle 13 is funnel-like or conical. The ink-repellent film is formed on at least the outside surface of the nozzle plate 14.

The piezoelectric vibrating member 15 is a so-called distortion vibration mode of piezoelectric vibrating member. If the distortion vibration mode of piezoelectric vibrating member 15 is used, when charged, the piezoelectric vibrating member 15 contracts in a direction perpendicular to a direction of the electric field. Then, a pressure chamber 16 corresponding to the piezoelectric vibrating member 15 is caused to contract. When the electric charges are discharged from the piezoelectric vibrating member 15, the piezoelectric vibrating member 15 extends in the direction perpendicular to the direction of the electric field. Then, a pressure chamber 16 corresponding to the piezo electric vibrating member 15 is caused to expand.

That is, in the recording head 10, a volume of the pressure chamber 16 may be changed by the corresponding piezoelectric vibrating member 15 charged or discharged. This may cause pressure of the ink in the pressure chamber 16 to change, so that a drop of the ink maybe ejected from the corresponding nozzle 13.

A so-called longitudinal vibration mode of piezoelectric vibrating member may be used instead of the distortion vibration mode of piezoelectric vibrating member 15. In a case using the longitudinal vibration mode of piezoelectric vibrating member, the corresponding pressure chamber can expand by deformation of the piezoelectric vibrating member when the piezoelectric vibrating member is charged, and can contract by deformation of the piezoelectric vibrating member when the piezoelectric vibrating member is discharged.

In the printer 1 as described above, a drop of the ink may be ejected from the recording head 10 synchronously with the main scanning of the carriage 2, during a recording operation. A platen may be rotated in cooperation with the reciprocation of the carriage 2 so that the recording paper 8 is fed in a feeding (sub-scanning) direction. As a result, images, characters or the like, based on recording data, are recorded on the recording paper 8.

Figure 3:
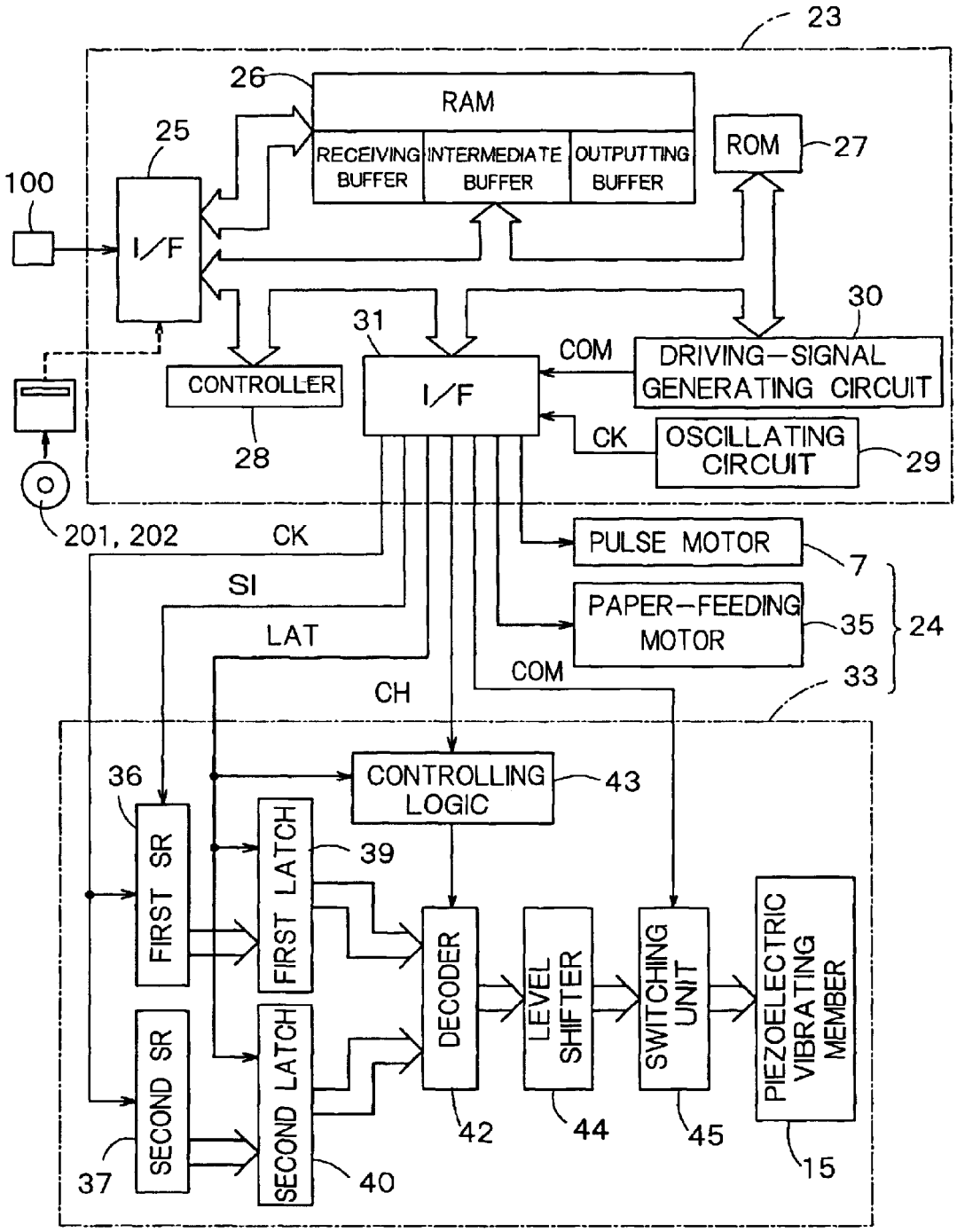
FIG. 3 is a block diagram for explaining an electric structure of the printer.

Then, an electric structure of the ink-jetting printer is explained. As shown in FIG. 3, the printer 1 has a printer controller 23 and a printing engine 24.

The printer controller 23 has: an outside interface (outside I/F) 25; a RAM 26 that temporarily stores various data; a ROM 27 that stores a controlling program or the like; a controlling part 28 including a CPU or the like; an oscillating circuit 29 that generates a clock signal (CK); a driving-signal generating circuit 30 that generates driving signals (COM) for supplying to the recording head 10 (which is explained in detail later); and an inside interface (inside I/F) 31 that transmits the driving signals, dot pattern data (bit map data) developed based on printing data (ejecting data) or the like to the printing engine 24.

The outside I/F 25 is adapted to receive the printing data consisting of character codes, graphic functions, image data or the like, from a host computer (not shown) or the like. In addition, a busy signal (BUSY) and/or an acknowledge signal (ACK) is outputted to the host computer or the like through the outside I/F 25.

Figure 9:
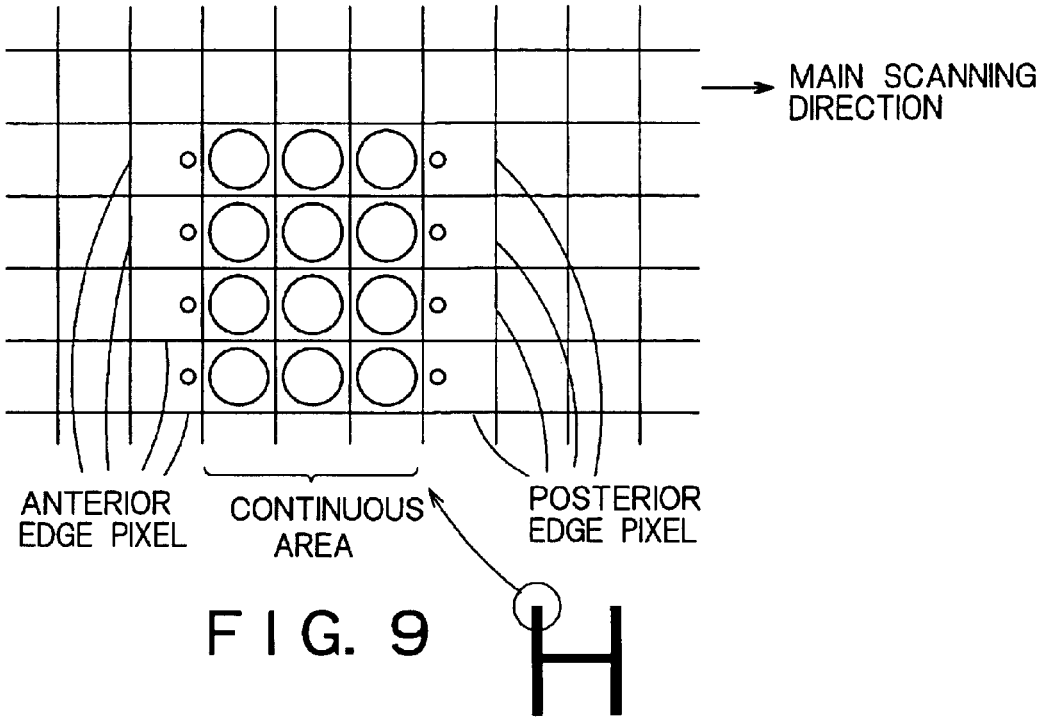
FIG. 9 is a view showing an example of ejecting state of respective drops of liquid in a high-quality edge-processing mode.

In the embodiment, the printing data received by the outside I/F 25 includes: ejecting-sequential data corresponding to a continuous area of level data of relatively high density, an anterior edge data preceding the continuous area, and a posterior edge data following the continuous area (see FIG. 9).

Figure 4:
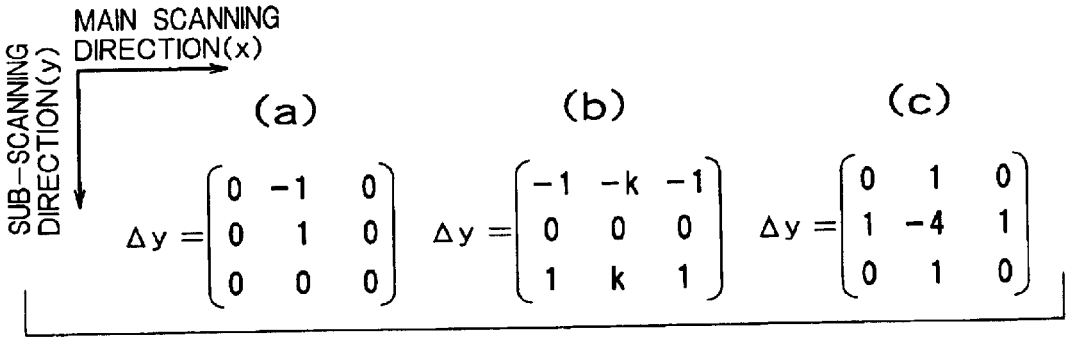
FIG. 4 is a view showing filters that can be used for extracting a contour.

Herein, the extraction of edge pixels (edge data) can be conducted, for example by an edge-extracting part in the host computer, for example by utilizing a linear differential filter as shown in (a) of FIG. 4. The filter has a directional property in the sub-scanning direction, so that the filter can extract one or more contours parallel with the main scanning direction. Herein, each of the contours is defined by an area that has a width of one pixel and that forms an outermost periphery of an image area consisting of pixels in which particular kinds of dots are formed. The contours are adjacent to a discontinuous portion of a feature parameter (dot size or dot color) defining the image area. The discontinuous portion is for example a border between a pixel in which a dot is formed and a pixel in which no dot is formed.

The filter for extracting the contour may be another filter having a directional property as shown in (b) of FIG. 4, or another filter having no directional property as shown in (c) of FIG. 4.

In addition, the outside I/F 25 in the embodiment is connected to an interface unit 100 such as a keyboard, which may function as a quality-mode setting unit for setting a normal mode or a high-quality edge-processing mode, regarding recording accuracy to the recording paper 8 (medium for recording) of the embodiment.

The RAM26 has a receiving buffer, an intermediate buffer, an outputting buffer and a work memory (not shown). The receiving buffer can temporarily store the printing data received via the outside I/F 25. The intermediate buffer can store intermediate code data converted by the controlling part 28. The outputting buffer can store dot pattern data. The dot pattern data mean printing data obtained by decoding (translating) the intermediate code data.

The ROM 27 stores font data, graphic functions or the like as well as the controlling program (controlling routine) for conducting various data-processes.

The controlling part 28 is adapted to conduct various controls according to the controlling program stored in the ROM 27. For example, the controlling part 28 reads out the printing data in the receiving buffer, converts the printing data into the intermediate code data, and causes the intermediate buffer to store the intermediate code data. In addition, the controlling part 28 analyzes the intermediate code data read out from the intermediate buffer, and develops (decodes) the intermediate code data into the dot pattern data with reference to the font data and the graphic functions or the like stored in the ROM 27. Then, the controlling part 28 conducts necessary decoration processes to the dot pattern data, and causes the outputting buffer to store the dot pattern data. In the case, each of the dot pattern data consists of two bit data as a level data. That is, the controlling part 28 may function as a level-data setting unit.

After dot pattern data for one line, which correspond to one main scanning movement of the recording head 10, are obtained, the dot pattern data for the one line is outputted in turn from the outputting buffer to the recording head 10 via the inside I/F 31. When the dot pattern data for the one line is outputted from the outputting buffer, the intermediate code data that have already been developed are erased from the intermediate buffer. Then, the next intermediate code data start to be developed.

In addition, the controlling part 28 may function as apart of timing signal generating unit, that is, supply latch signals (LAT) and/or channel signals (CH) to the recording head 10 via the inside I/F 31. The latch signals and/or the channel signals define starting timings for supplying driving pulses, each of which forms a part of a driving signal (COM).

However, the printing engine 24 has: a paper-feeding motor 35 as a paper-feeding mechanism; the pulse motor 7 as a carriage-moving mechanism; and an electric driving system 33 for the recording head 10. The paper-feeding motor 35 causes the platen 34 (see FIG. 1) to rotate in order to feed the recording paper 8. The pulse motor 7 causes the carriage 2 to move via the timing belt 6.

As shown in FIG. 3, the electric driving system 33 for the recording head 10 has: a shift-register circuit consisting of a first shift-register 36 and a second shift-register 37; a latch circuit consisting of a first latch-circuit 39 and a second latch-circuit 40; a decoder 42; a controlling logic circuit 43; a level shifter 44; a switching circuit 45; and the piezoelectric vibrating members 15.

Figure 5:
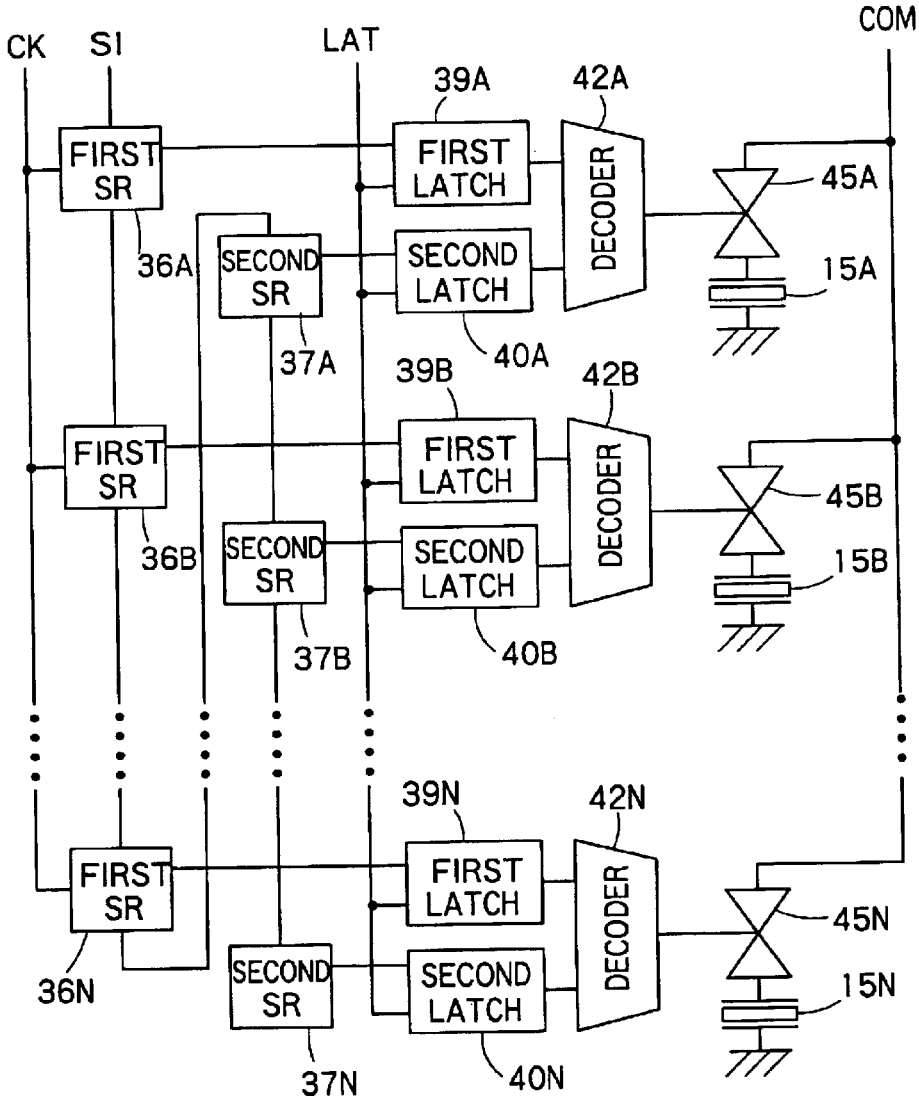
FIG. 5 is a block diagram for explaining an electric driving structure of the recording head.

As shown in FIG. 5, the first shift-register 36 has a plurality of first shift-register devices 36A to 36N, each of which corresponds to each of the nozzles 13 of the recording head 10. Similarly, the second shift-register 37 has a plurality of second shift-register devices 37A to 37N, each of which corresponds to each of the nozzles 13 of the recording head 10. The first latch-circuit 39 has a plurality of first latch-circuit devices 39A to 39N, each of which corresponds to each of the nozzles 13 of the recording head 10. Similarly, the second latch-circuit 40 has a plurality of second latch-circuit devices 40A to 40N, each of which corresponds to each of the nozzles 13 of the recording head 10. The decoder 42 has a plurality of decoder devices 42A to 42N, each of which corresponds to each of the nozzles 13 of the recording head 10. The switching circuit 45 has a plurality of switching circuit devices 45A to 45N, each of which corresponds to each of the nozzles 13 of the recording head 10. The piezoelectric vibrating members 15 are also designated as piezoelectric vibrating members 15A to 15N, each of which corresponds to each of the nozzles 13 of the recording head 10.

According to the electric driving system 33, the recording head 10 can eject a drop of the ink, based on the printing data (level information) from the printer controller 23. The printing data (SI) from the printer controller 23 are transmitted in a serial manner to the first shift-register 36 and the second shift-register 37 via the inside I/F 31, synchronously with the clock signal (CK) from the oscillating circuit 29.

The printing data from the printer controller 23 are data consisting of 2 bits as described above. In detail, when a normal mode is set, four levels consisting of no recording, a small dot, a middle dot and a large dot are available. That is, the level data of no recording is represented by "00", the level data of the small dot is represented by "01", the level data of the middle dot is represented by "10", and the level data of the large dot is represented by "11". On the other hand, when a high-quality edge-processing mode is set, four levels consisting of no recording, a first small dot, a second small dot and a large dot are available. That is, the level data of no recording is represented by "00", the level data of the first small dot is represented by "01", the level data of the second small dot is represented by "10", and the level data of the large dot is represented by "11".

The printing data are set for each of printing dots, that is, each of the nozzles 13. Then, the lower bits of the printing data for all the nozzles 13 are inputted in the first shift-register devices 36 (36A to 36N), respectively. Similarly, the upper bits of the printing data for all the nozzles 13 are inputted in the second shift-register devices 37 (37A to 37N), respectively.

As shown in FIG. 3, the first shift-register 36 is electrically connected to the first latch-circuit 39. Similarly, the second shift-register 37 is electrically connected to the second latch-circuit 40. When the latch signals (LAT) from the printer controller 23 are inputted to the first and the second latch-circuit 39 and 40, the first latch-circuit 39 latches the lower bits of the printing data, and the second latch-circuit 40 latches the upper bits of the printing data.

As described above, a circuit unit consisting of the first shift-register 36 and the first latch-circuit 39 may function as a storing circuit. Similarly, a circuit unit consisting of the second shift-register 37 and the second latch-circuit 40 may also function as a storing circuit. That is, these circuit units can temporarily store the printing data (level information) before inputted to the decoder 42.

The printing data latched in the latch-circuits 39 and 40 are supplied to the decoder 42A to 42N. The decoder 42 translates the printing data (level data) of the two bits into pulse-selecting data (pulse-selecting information). Each of the pulse-selecting data has a plurality of bits equal to or more than the level data, each of the plurality of bits corresponds to a pulse-wave forming a part of the driving signal (COM). Then, depending on each of the bits of the pulse selecting data ("0" or "1"), each of the pulse-waves may be supplied or not to the piezoelectric vibrating member 15. The driving signal (COM) and the pulse-waves will be described in detail hereafter.

In addition, timing signals from the controlling logic circuit 43 are also inputted to the decoder 42. The controlling logic circuit 43 may function as a timing-signal generator together with the controlling part 28, in order to generate the timing signals based on the latch signals (LAT) and the channel signals (CH).

The pulse-selecting data translated by the decoder 42 are inputted to the level shifter 44 in turn from an uppermost bit thereof to a lowermost bit thereof at respective timings defined by the timing signals. For example, the uppermost bit of the pulse-selecting data is inputted to the level shifter 44 at the first timing of a recording period, and the second uppermost bit of the pulse-selecting data is inputted to the level shifter 44 at the second timing.

The level shifter 44 is adapted to function as a voltage amplifier. For example, when a bit of the pulse-selecting data is "1", the level shifter 44 raises the datum "1" to a voltage of several decade volts that can drive the switching circuit 45.

The raised datum is applied to the switching circuit 45, which may function as a driving-pulse generator and a controlling body. That is, the switching circuit 45 selects and generates one or more driving pulses from the driving signal (COM), based on the pulse-selecting data generated by translating the printing data. The generated one or more driving pulses are supplied to the piezoelectric vibrating member 15. For the purpose, input terminals of the switching circuit 45 are adapted to be supplied the driving signal (COM) from the driving-signal generating circuit 30, and output terminals thereof are connected to the piezo electric vibrating members 15.

The switching circuit 45 is controlled by the pulse-selecting data. That is, a switching device 45 is closed (connected) when a bit of the pulse-selecting data is "1". Then, the corresponding driving pulse is supplied to the corresponding piezoelectric vibrating member 15. Thus, an electric-potential level of the piezoelectric vibrating member 15 is changed.

On the other hand, when a bit of the pulse-selecting data is "0", a level shifter device 44 does not output an electric signal for operating the corresponding switching circuit 45. Then, the switching circuit device 45 is not connected, so that the corresponding driving pulse is not supplied to the corresponding piezoelectric vibrating member 15. While a bit of the pulse-selecting data is "0", the piezoelectric vibrating member 15 holds a previous electric-potential level.

Then, the driving signal (COM) generated by the driving-signal generating circuit 30 and a control of ejecting one or more drops of the ink by means of the driving signal are explained in detail.

Figure 6:
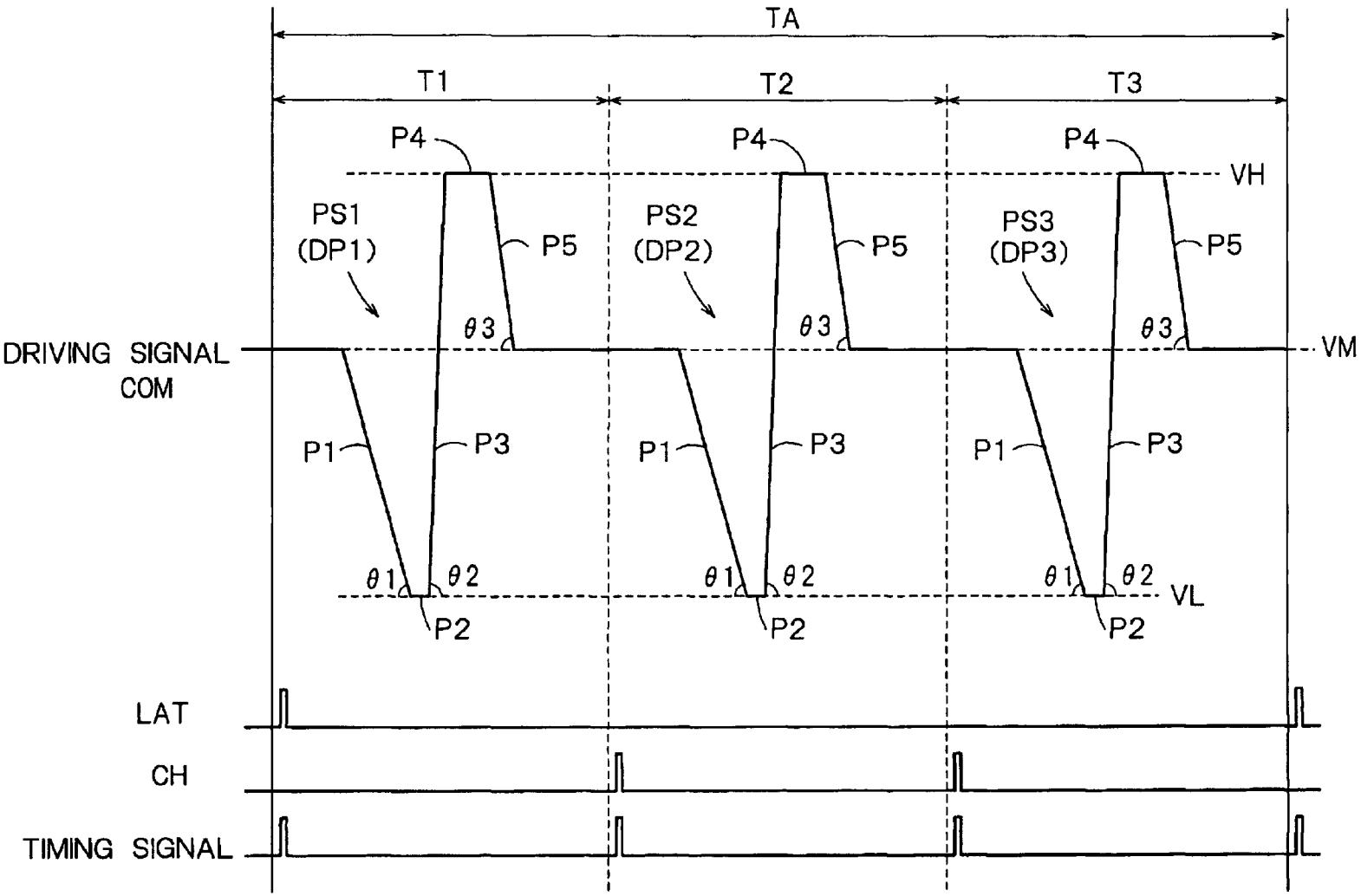
FIG. 6 is a diagram of an example of a driving signal.

An example of the driving signal (COM) is shown in FIG. 6. As shown in FIG. 6, the driving signal A has a first pulse signal PS1 arranged in a term T1, a second pulse signal PS2 arranged in a term T2 and a third pulse signal PS3 arranged in a term T3, which are connected in a series manner. The driving signal A is a pulse-row signal having a recording period TA. In the case, the recording period TA corresponds to a frequency of 8.57 kHz (⅓ of 25.71 kHz). In the driving signal A, the first pulse signal PS1 is adapted to function as a first driving pulse DP1, the second pulse signal PS2 is adapted to function as a second driving pulse DP2, and the third pulse signal PS3 is adapted to function as a third driving pulse DP3.

The first driving pulse DP1, the second driving pulse DP2 and the third driving pulse DP3 have a common wave-pattern (wave form). Each of them can eject a drop of the ink alone.

That is, each of the driving pulses DP1, DP2 and DP3 includes: a first discharging element P1 falling from a middle electric potential VM to a lowest electric potential VL at an incline θ1, a first holding element P2 maintaining the lowest electric potential VL for a short time, a first charging element P3 rising from the lowest electric potential VL to a highest electric potential VH at a steep incline θ2 within a very short time, a second holding element P4 maintaining the highest electric potential VH for a time, and a second discharging element P5 falling from the highest electric potential VH to the middle electric potential VM at an incline θ3.

When each of the driving pulses is supplied to the piezoelectric vibrating member 15, a drop of the ink, whose volume corresponds to a small dot, is ejected from the nozzle 13.

In detail, when the first discharging element P1 is supplied to the piezoelectric vibrating member 15, the piezoelectric vibrating member 15 is discharged from the middle electric potential VM. Then, the corresponding pressure chamber 16 is caused to expand from a standard volume thereof to a maximum volume thereof. Then, by the first charging element P3, the pressure chamber 16 is caused to rapidly contract to a minimum volume thereof. Such a contracting state of the pressure chamber 16 is maintained while the second holding element P4 is supplied to the piezo electric vibrating member 15. The rapid contraction and the keeping of the contracting state of the pressure chamber 16 raise a pressure of the ink in the pressure chamber 16 so rapidly that a drop of the ink is ejected from the nozzle 13. A volume of the ejected drop of the ink is for example about 13 pL. Then, by the second discharging element P5, the pressure chamber 16 is caused to expand back to an original state thereof in order to settle down a vibration of a meniscus within a short time.

Herein, the normal mode is explained in detail.

Figure 7:
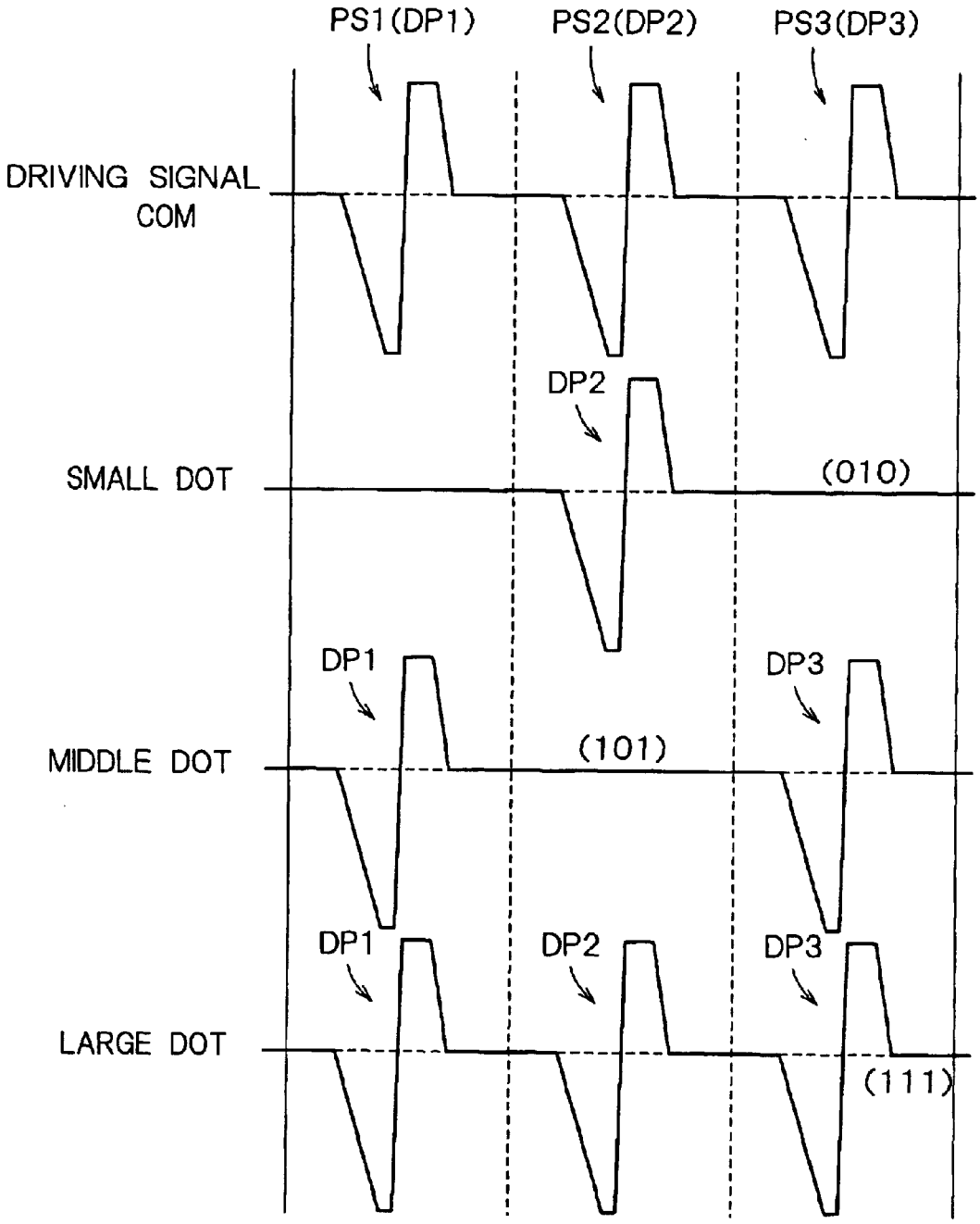
FIG. 7 is diagrams for explaining driving pulses generated based on the driving signal of FIG. 6 in a normal mode.

As shown in FIG. 7, a level control can be achieved by increasing or decreasing the number of the driving pulses supplied to the piezoelectric vibrating member 15. For example, when only one driving pulse (pulse-wave) is supplied to the piezoelectric vibrating member 15, a small dot of the ink is formed for recording. When only two driving pulses are supplied to the piezo electric vibrating member 15, a middle dot of the ink is formed for recording. When all the three driving-pulses are supplied to the piezoelectric vibrating member 15, a large dot of the ink is formed for recording.

Then, pulse-selecting data generated based on the small-dot dot-pattern data (level information 01), the middle-dot dot-pattern data (level information 10) and the large-dot dot-pattern data (level information 11) are explained in detail.

In the case, the decoder 42 generates pulse-selecting data consisting of three bits, based on the small-dot dot-pattern data (level information 01), the middle-dot dot-pattern data (level information 10) and the large-dot dot-pattern data (level information 11), respectively.

Each of the three bits corresponds to each of the pulse-waves. That is, an uppermost bit of the pulse-selecting data corresponds to the first pulse-wave PS1 (the first driving pulse DP1). A second uppermost bit of the pulse-selecting data corresponds to the second pulse-wave PS2 (the second driving pulse DP2). A lowermost bit of the pulse-selecting data corresponds to the third pulse-wave PS3 (the third driving pulse DP3).

In the case, the pulse-selecting data generated based on the small-dot dot-pattern data (level information 01) is "010". Similarly, the pulse-selecting data generated based on the middle-dot dot-pattern data (level information 10) is "101", and the pulse-selecting data generated based on the large-dot dot-pattern data (level information 11) is "111".

When the uppermost bit of the pulse-selecting data is "1", the switching circuit 45 (driving-pulse generator) is closed (connected) from a first timing signal (LAT signal), which is generated when the term T1 starts, to a second timing signal (CH signal), which is generated when the term T2 starts. In addition, when the second uppermost bit of the pulse-selecting data is "1", the switching circuit 45 is closed from the second timing signal to a third timing signal (CH signal), which is generated when the term T3 starts. Similarly, when the lowermost bit of the pulse-selecting data is "1", the switching circuit 45 is closed from the third timing signal to a timing signal (LAT signal) which is generated when the term T1 of the next printing period TA starts.

Thus, based on the small-dot dot-pattern data, only the second driving pulse DP2 is supplied to the corresponding piezoelectric vibrating member 15. Similarly, based on the middle-dot dot-pattern data, only the first driving pulse DP1 and the third driving pulse DP3 are supplied to the corresponding piezo electric vibrating member 15. In addition, based on the large-dot dot-pattern data, all the first driving pulse DP1, the second driving pulse DP2 and the third driving pulse DP3 are supplied to the corresponding piezoelectric vibrating member 15 in succession.

As a result, correspondingly to the small-dot dot-pattern data, one drop of the ink of 13 pL is ejected from the nozzle 13. Thus, a small dot is formed on the recording paper 8. Correspondingly to the middle-dot dot-pattern data, two drops of the ink of 13 pL are ejected from the nozzle 13. The total volume of the ejected drops of the ink is 26 pL. Thus, a middle dot is formed on the recording paper 8. Correspondingly to the large-dot dot-pattern data, three drops of the ink of 13 pL are ejected from the nozzle 13. The total volume of the ejected drops of the ink is 39 pL. Thus, a large dot is formed on the recording paper 8.

Next, the high-quality edge-processing mode is explained in detail.

Figure 8:
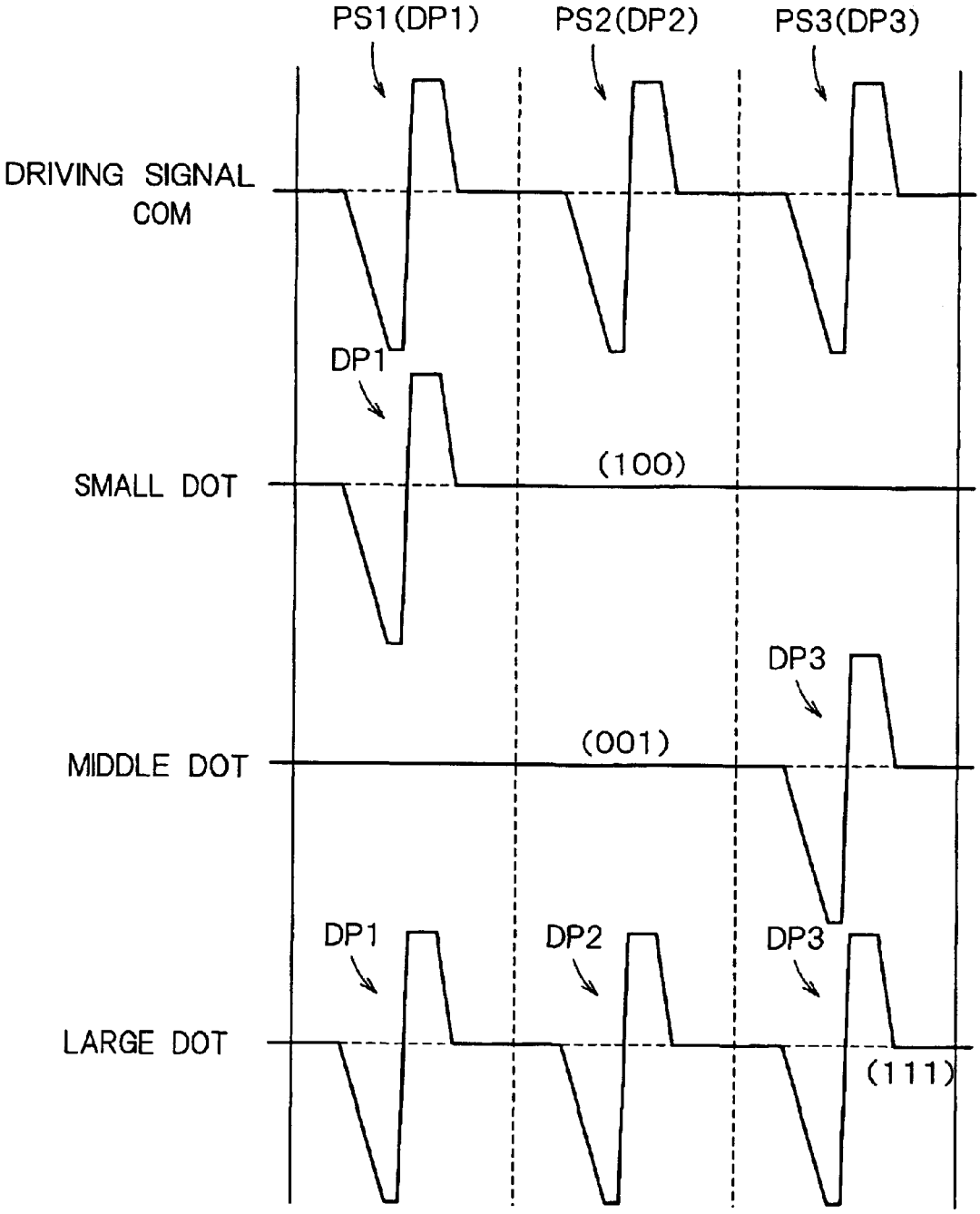
FIG. 8 is diagrams for explaining driving pulses generated based on the driving signal of FIG. 6 in a high-quality edge-processing mode.

As shown in FIG. 8, in this mode as well, a level control can be achieved by increasing or decreasing the number of the driving pulses supplied to the piezoelectric vibrating member 15. Herein, when only one driving pulse (pulse-wave) is supplied to the piezoelectric vibrating member 15, a small dot of the ink is formed for recording. When the three driving-pulses are supplied to the piezoelectric vibrating member 15, a large dot of the ink is formed for recording.

Herein, a case wherein an alphabet "H" is printed is explained in detail with reference to FIG. 9.

By the controlling part 28 as the level-data setting unit, a high-density level data (11) is set as a dot-pattern data for each of pixels (ejecting-sequential data) included in a solid portion (continuous area) of the character "H". A first low-density level data (01) is set as a dot-pattern data for each of pixels of anterior edges (anterior edge data) on the left side of the character "H" (on the preceding side in the main scanning direction). A second low-density level data (10) is set as a dot-pattern data for each of pixels of posterior edges (posterior edge data) on the right side of the character "H" (on the following side in the main scanning direction). A zero level data (00) is set as a dot-pattern data for each of the other pixels.

In the case, the decoder 42 generates pulse-selecting data consisting of three bits, based on the high-density level data (11), the first low-density level data (01) and the second low-density level data (10), respectively.

Each of the three bits corresponds to each of the pulse-waves. That is, an uppermost bit of the pulse-selecting data corresponds to the first pulse-wave PS1 (the first driving pulse DP1: a first small-dot pulse-wave). A second uppermost bit of the pulse-selecting data corresponds to the second pulse-wave PS2 (the second driving pulse DP2: a third pulse-wave). A lowermost bit of the pulse-selecting data corresponds to the third pulse-wave PS3 (the third driving pulse DP3: a second small-dot pulse-wave).

In the case, the pulse-selecting data generated based on the high-density level data (11) is "111". Similarly, the pulse-selecting data generated based on the first low-density level data (01) is "001", and the pulse-selecting data generated based on the second low-density level data (10) is "100".

When the uppermost bit of the pulse-selecting data is "1", the switching circuit 45 (driving-pulse generator) is closed (connected) from a first timing signal (LAT signal), which is generated when the term T1 starts, to a second timing signal (CH signal), which is generated when the term T2 starts. In addition, when the second uppermost bit of the pulse-selecting data is "1", the switching circuit 45 is closed from the second timing signal to a third timing signal (CH signal), which is generated when the term T3 starts. Similarly, when the lowermost bit of the pulse-selecting data is "1", the switching circuit 45 is closed from the third timing signal to a timing signal (LAT signal) which is generated when the term T1 of the next printing period TA starts.

Thus, based on the first low-density level data (01), only the third driving pulse DP3 (a second small-dot pulse-wave) is supplied to the corresponding piezoelectric vibrating member 15. Similarly, based on the high-density level data (11), all the first driving pulse DP1 (a first small-dot pulse-wave), the second driving pulse DP2 (a third pulse-wave) and the third driving pulse DP3 (a second small-dot pulse-wave) are supplied to the corresponding piezoelectric vibrating member 15 in succession. In addition, based on the second low-density level data (10), only the first driving pulse DP1 (a first small-dot pulse-wave) is supplied to the corresponding piezoelectric vibrating member 15.

As a result, correspondingly to the first low-density level data (01) corresponding to the anterior edge data, one drop of the ink of 13 pL is ejected from the nozzle 13. Thus, a small dot is formed on the recording paper 8. The position to which the drop of the ink is ejected is closer to the solid portion of the character "H" than the position to which the small dot is formed in the normal mode (by the second driving pulse DP2).

In addition, correspondingly to the high-density level data (11), three drops of the ink of 13 pL are ejected from the nozzle 13 in succession. The total volume of the ejected drops of the ink is 39 pL. Thus, a large dot is formed on the recording paper 8. In the case, the high-density level data (11) are serial in the main scanning direction so that the solid portion of the character "H" is fully printed (solid-printed).

In addition, correspondingly to the second low-density level data (10) corresponding to the posterior edge data, one drop of the ink of 13 pL is ejected from the nozzle 13. Thus, a small dot is formed on the recording paper 8. The position to which the drop of the ink is ejected is closer to the solid portion of the character "H" than the position to which the small dot is formed in the normal mode (by the second driving pulse DP2).

Figure 20:
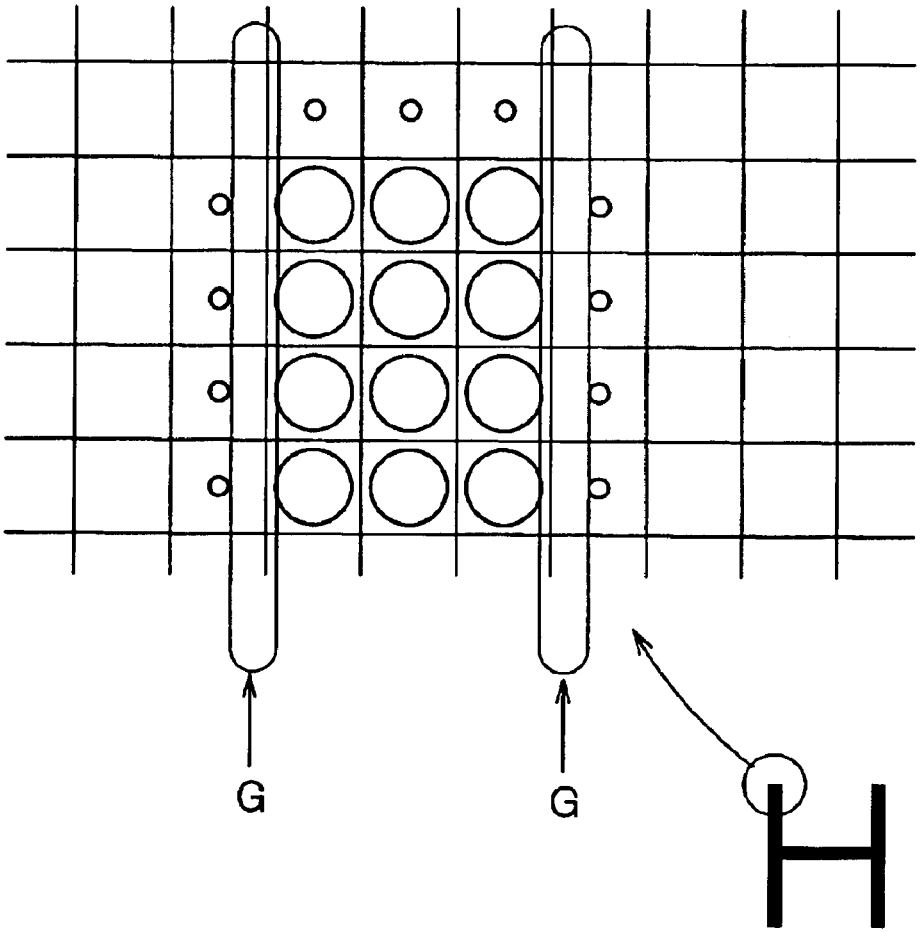
FIG. 20 is a view showing an example of edge-processing state according to the invention of Japanese Patent Application No. 2001-194025.

As described above, according to the embodiment, setting of level data for the pixels of the anterior edges and setting of level data for the pixels of the posterior edges are independently conducted, and different level data are set for the pixels of the anterior edges and for the pixels of the posterior edges. Thus, both the small drops of the ink ejected for the pixels of the anterior edges and the small drops of the ink ejected for the pixels of the posterior edges are ejected to positions closer to the solid portion (continuous area). Thus, it is possible to much effectively restrain generation of a gap line (see FIG. 20) that can be perceived at an edge portion. Thus, an edge process to restrain bleeding of the ink can be achieved with much higher quality.

Next, another embodiment of the invention is explained with reference to FIG. 10. In this embodiment as well, an alphabet "H" is printed.

A high-density level data (11) is set as a dot-pattern data for each of pixels (ejecting-sequential data) included in a solid portion (continuous area) of the character "H". A first low-density level data (01) is set as a dot-pattern data for each of pixels of anterior edges (anterior edge data) on the left side of the character "H" (on the preceding side in the main scanning direction). A second low-density level data (10) is set as a dot-pattern data for each of pixels of posterior edges (posterior edge data) on the right side of the character "H" (on the following side in the main scanning direction). A zero level data (00) is set as a dot-pattern data for each of the other pixels. These correspondences are substantially the same as the above embodiment explained with reference to FIG. 9.

In this embodiment, pixels adjacent to the solid portion (continuous area) of the character "H" in the sub-scanning direction correspond to the first low-density level data (01) or the second low-density level data (10), as longitudinal edges.

Figure 10:
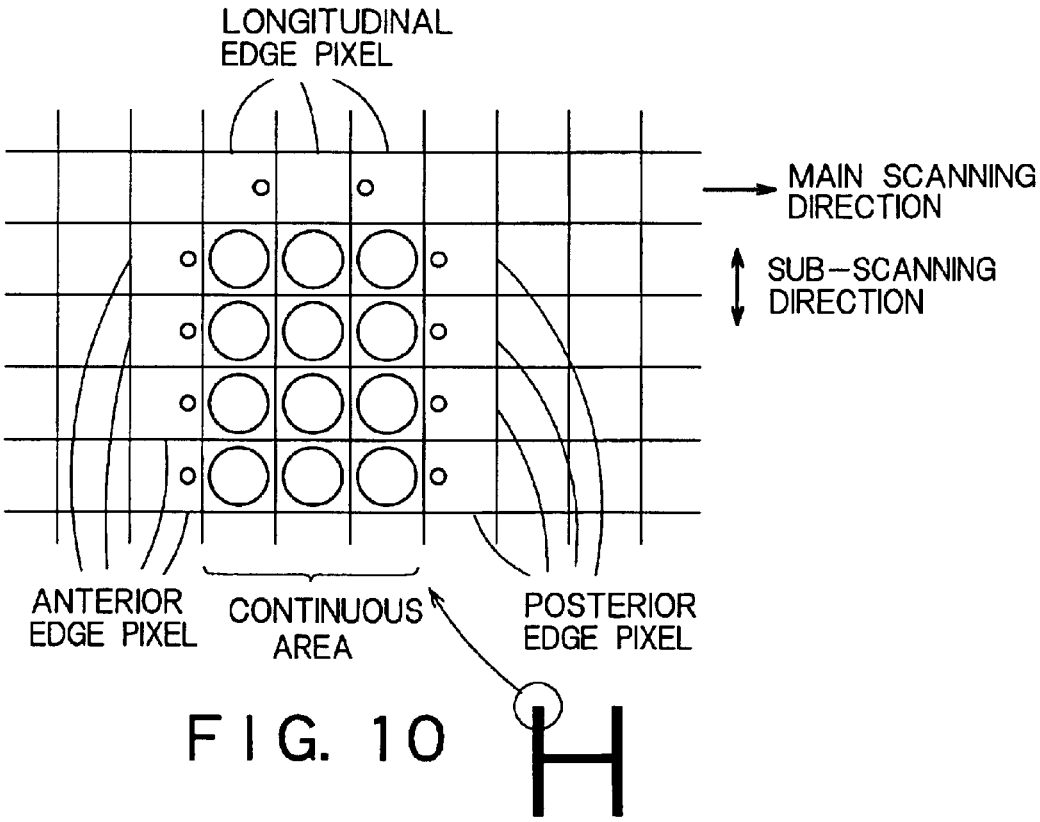
FIG. 10 is a view showing an example of ejecting state of respective drops of liquid when an edge process is conducted for longitudinal edge pixels.

In the case of FIG. 10, the number of pixels forming a group (row) of the longitudinal edges consecutive in the main scanning direction is three. Then, the first low-density level data is set for the former longitudinal-edge pixel (longitudinal edge data), the zero level data is set for the central longitudinal-edge pixel (longitudinal edge data), and the second low-density level data is set for the latter longitudinal-edge pixel (longitudinal edge data).

According to the embodiment, in the sub-scanning direction too, a good edge process can be achieved.

Figure 11:
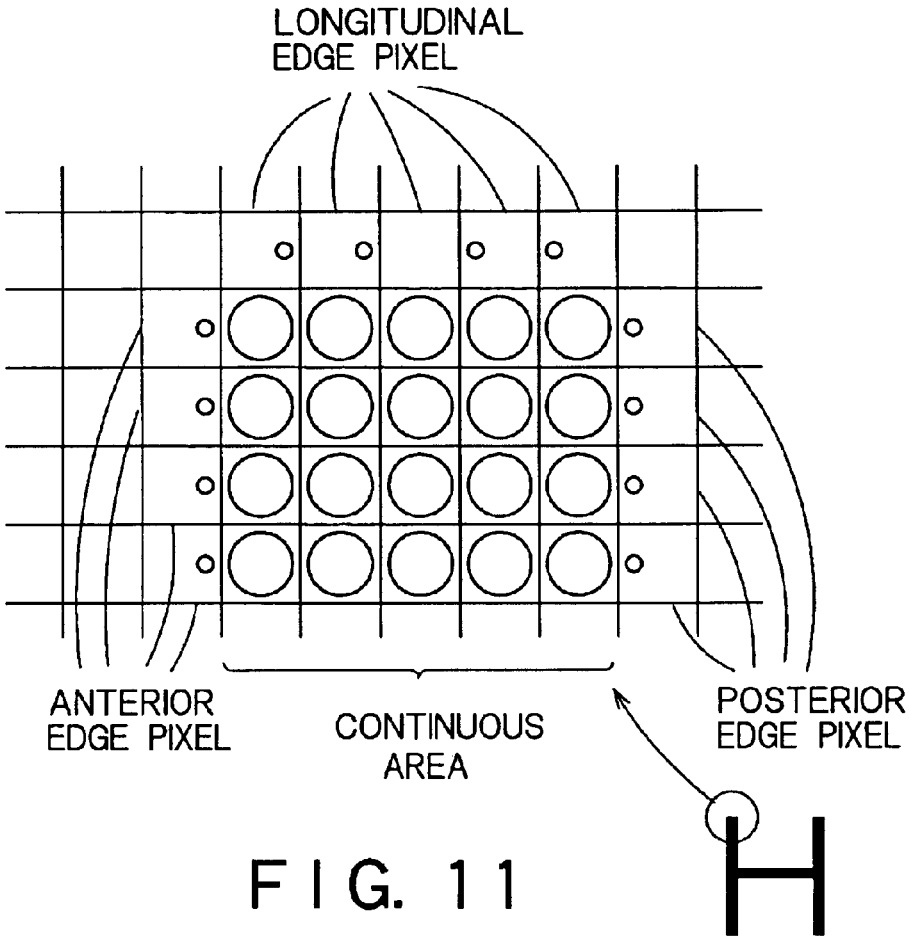
FIG. 11 is a view showing another example of ejecting state of respective drops of liquid when an edge process is conducted for longitudinal edge pixels.

If the number of pixels forming a group of the longitudinal edges consecutive in the main scanning direction is five or more odd number, a control of ejecting drops of liquid as shown in FIG. 11 is preferable.

In the ejecting control shown in FIG. 11, the zero level data is set for the central pixel of the consecutive longitudinal edges, the first low-density level data is set for the former pixels of the longitudinal edges with respect to the central pixel, and the second low-density level data is set for the latter pixels of the longitudinal edges with respect to the central pixel.

Figure 12A:
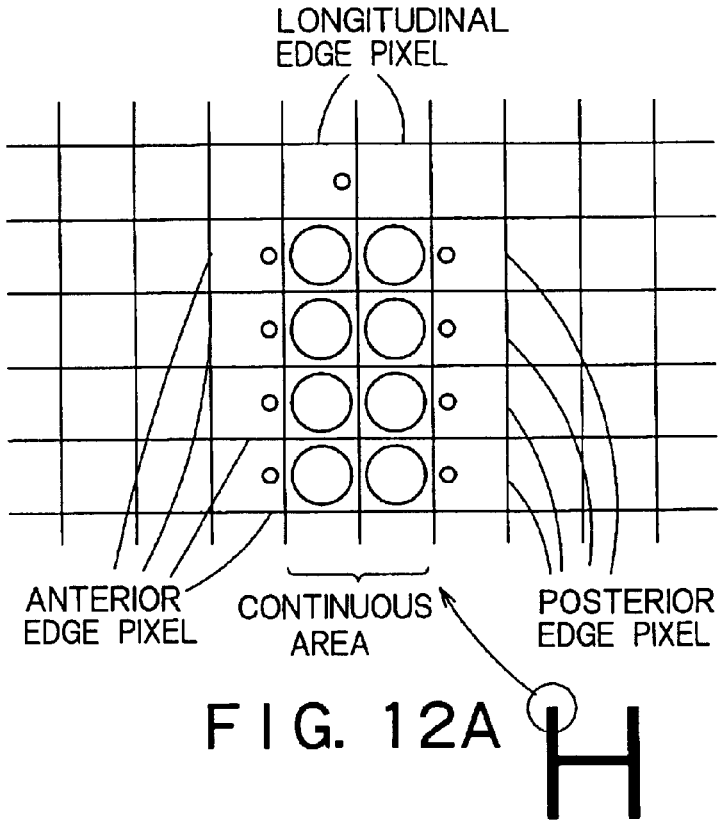
FIGS. 12A and 12B are views showing other examples of ejecting state of respective drops of liquid when edge processes are conducted for longitudinal edge pixels.
Figure 12B:
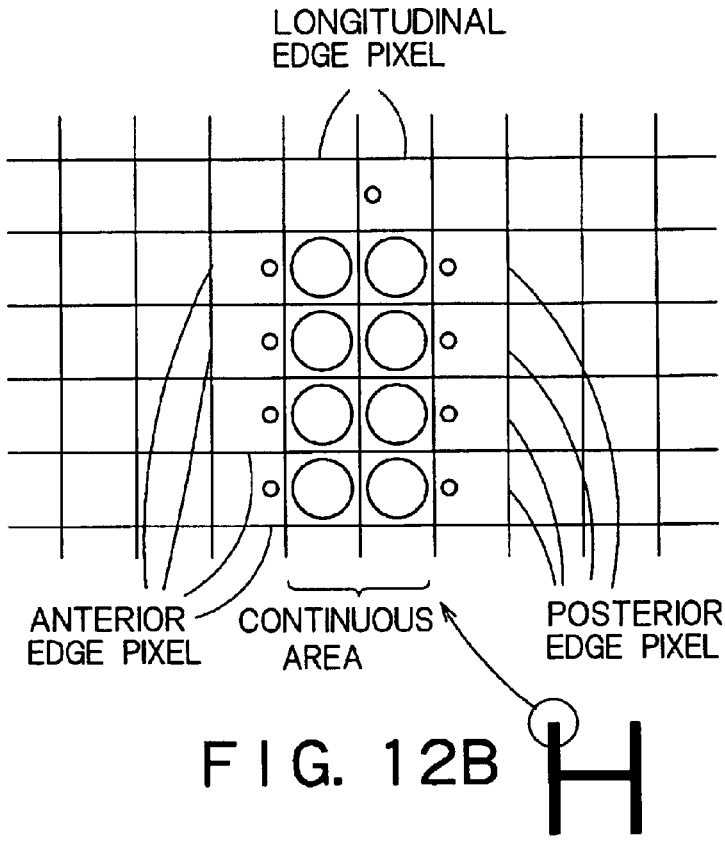
Figure 13:
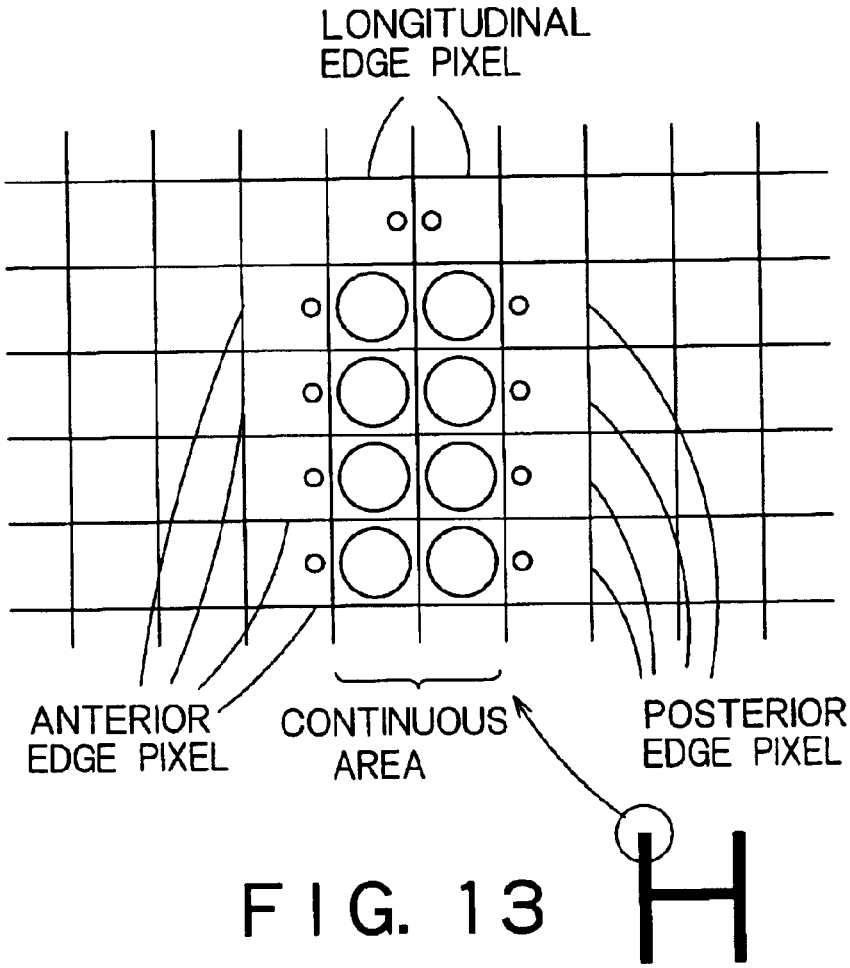
FIG. 13 is a view showing another example of ejecting state of respective drops of liquid when an edge process is conducted for longitudinal edge pixels.

If the number of pixels forming a group of the longitudinal edges consecutive in the main scanning direction is two, controls of ejecting drops of liquid as shown in FIGS. 12A, 12B and 13 are preferable.

In the ejecting controls shown in FIGS. 12A and 12B, one is selected from the former pixel and the latter pixel of the longitudinal edges consecutive in the main scanning direction. If the former pixel is selected, the first low-density level data is set for the former pixel (FIG. 12A). If the latter pixel is selected, the second low-density level data is set for the latter pixel (FIG. 12B). The zero level data is set for the unselected pixel of the former pixel and the latter pixel.

In the ejecting control shown in FIG. 13, the first low-density level data is set for the former pixel of the longitudinal edges, and the second low-density level data is set for the latter pixel of the longitudinal edges.

Figure 14A:
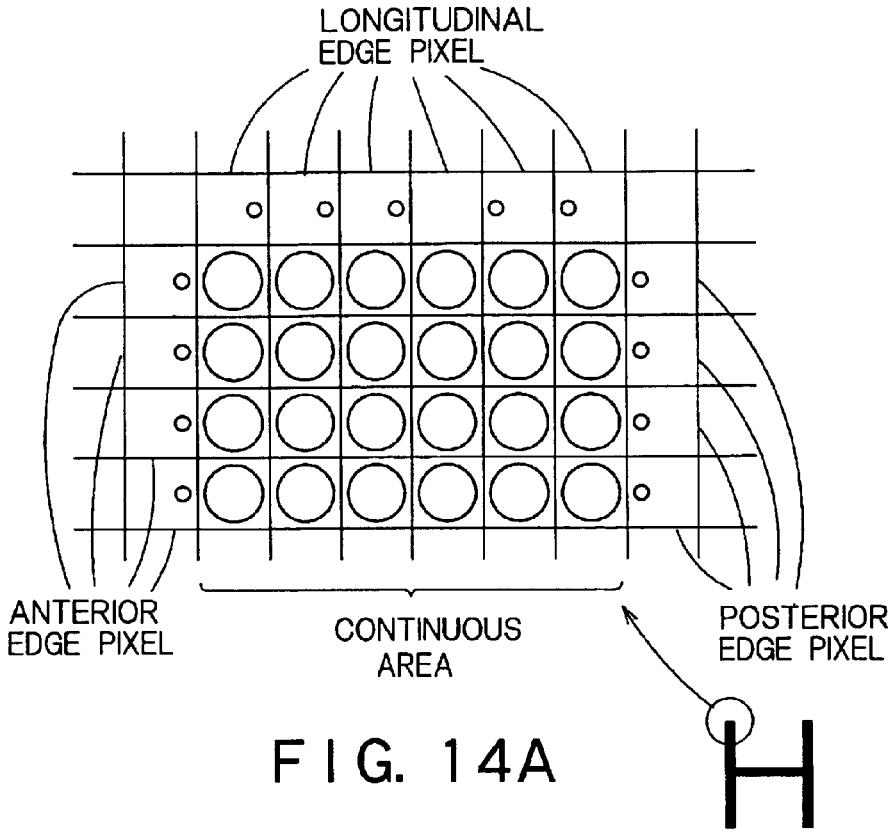
FIGS. 14A and 14B are views showing other examples of ejecting state of respective drops of liquid when edge processes are conducted for longitudinal edge pixels.
Figure 14B:
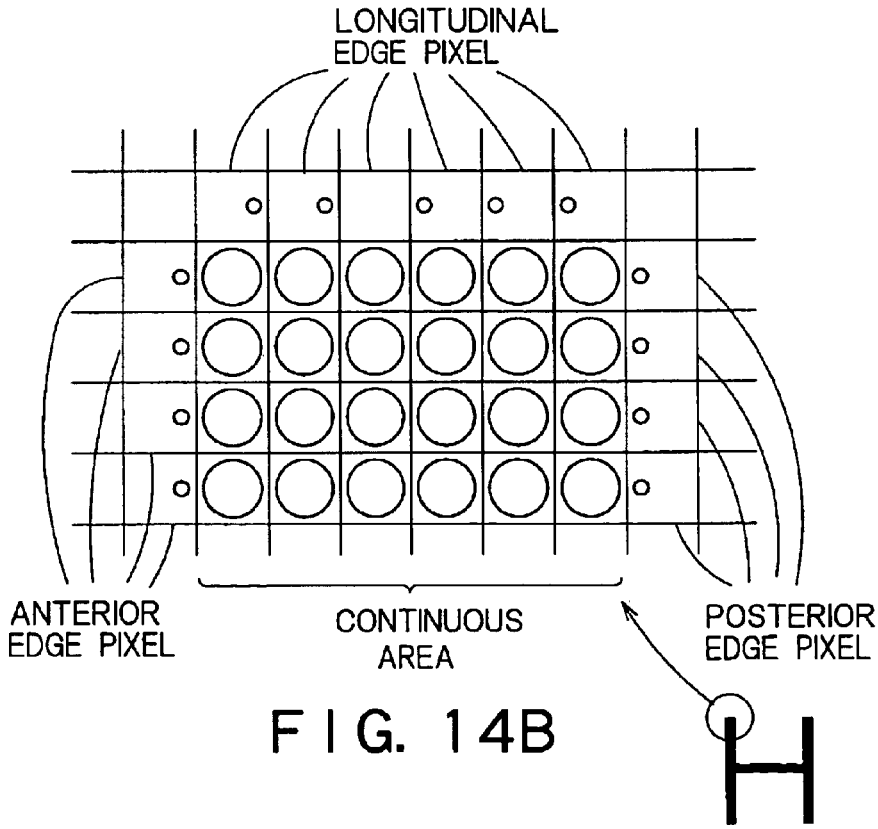
Figure 15:
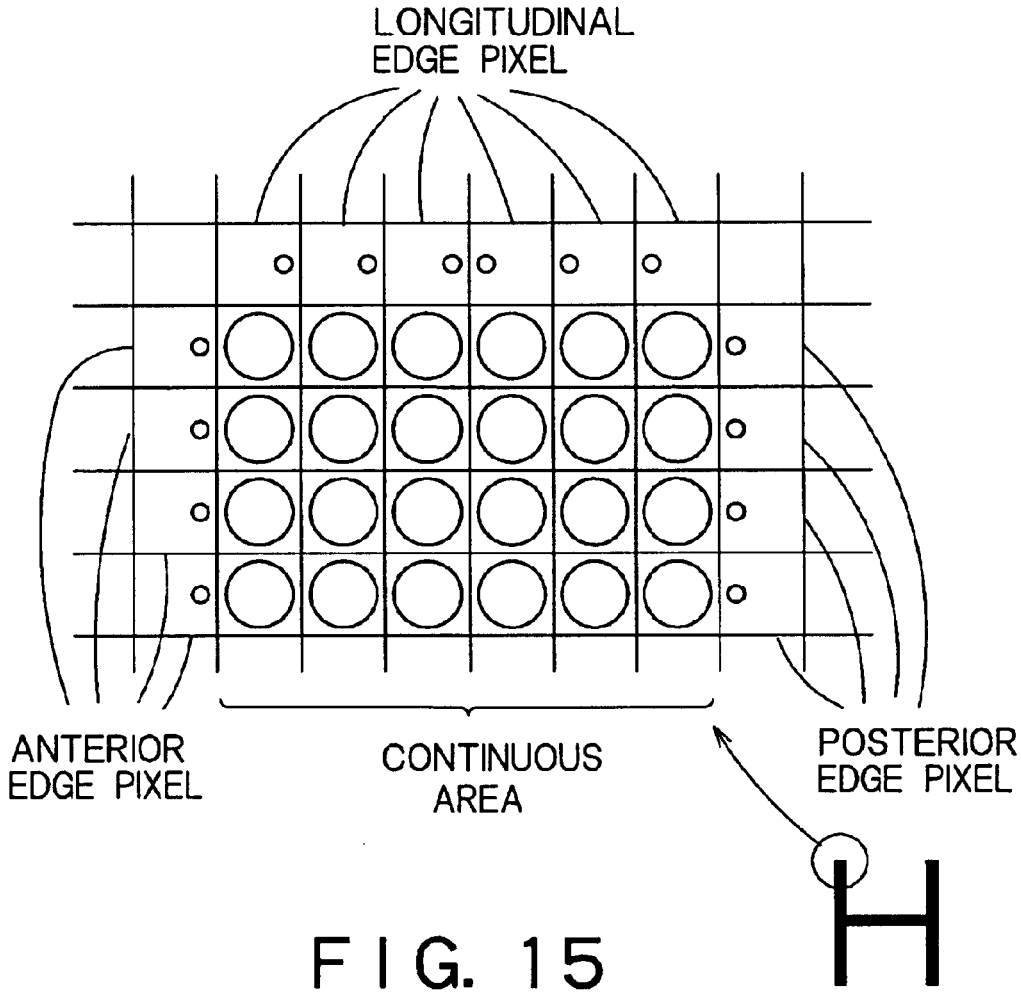
FIG. 15 is a view showing another example of ejecting state of respective drops of liquid when an edge process is conducted for longitudinal edge pixels.

If the number of pixels forming a group of the longitudinal edges consecutive in the main scanning direction is four or more even number, controls of ejecting drops of liquid as shown in FIGS. 14A, 14B and 15 are preferable.

In the ejecting controls shown in FIGS. 14A and 14B, one is selected from the two central pixels of the even longitudinal edges consecutive in the main scanning direction. If the former pixel from the two pixels is selected, the first low-density level data is set for the former pixel (FIG. 14A).

If the latter pixel from the two pixels is selected, the second low-density level data is set for the latter pixel (FIG. 14B). The zero level data is set for the unselected pixel of the two pixels. The first low-density level data is set for the former pixels of the longitudinal edges with respect to the central two pixels. The second low-density level data is set for the latter pixels of the longitudinal edges with respect to the central two pixels.

In the ejecting control shown in FIG. 15, the first low-density level data is set for the former half of the even pixels of the longitudinal edges consecutive in the main scanning direction, and the second low-density level data is set for the latter half of the even pixels of the longitudinal edges.

By any control shown in FIGS. 11 to 15, a good edge process in the sub-scanning direction can be achieved.

Regarding an edge process of a color ink other than the BK ink, in particular a light yellow ink or the like, existence of a gap line is not easily perceived. Thus, the edge process may be conducted by using not the high-quality edge-processing mode but the normal mode. In the edge process in the normal mode, a drop of liquid is ejected by the driving pulse DP2 commonly for each of all the edge pixels.

Thus, in a manner of edge process control, level data in the high-quality edge-processing mode may be used for one or more nozzle rows of the BK ink, while level data in the normal mode may be used for one or more nozzle rows of another ink different from the BK ink. In this manner, a plurality of kinds of level data supplied to the nozzle rows exist at the same time.

In addition, in general, the normal mode and the high-quality edge-processing mode may be switched by the main scanning. In the high-quality edge-processing mode, a drop of the liquid for a middle dot cannot be ejected. Thus, it is preferable that the high-quality edge-processing mode is used for only a part which needs the high-quality edge-process and that the normal mode is used for the other part.

The driving-signal generating circuit 30 may be formed by a DAC circuit or an analogue circuit.

In addition, in the driving signal COM (see FIG. 6) in the above embodiments, the first driving pulse DP1, the second driving pulse DP2 and the third driving pulse DP3 have the same wave form. However, the manner of a driving signal is not limited to this manner.

Figure 16:
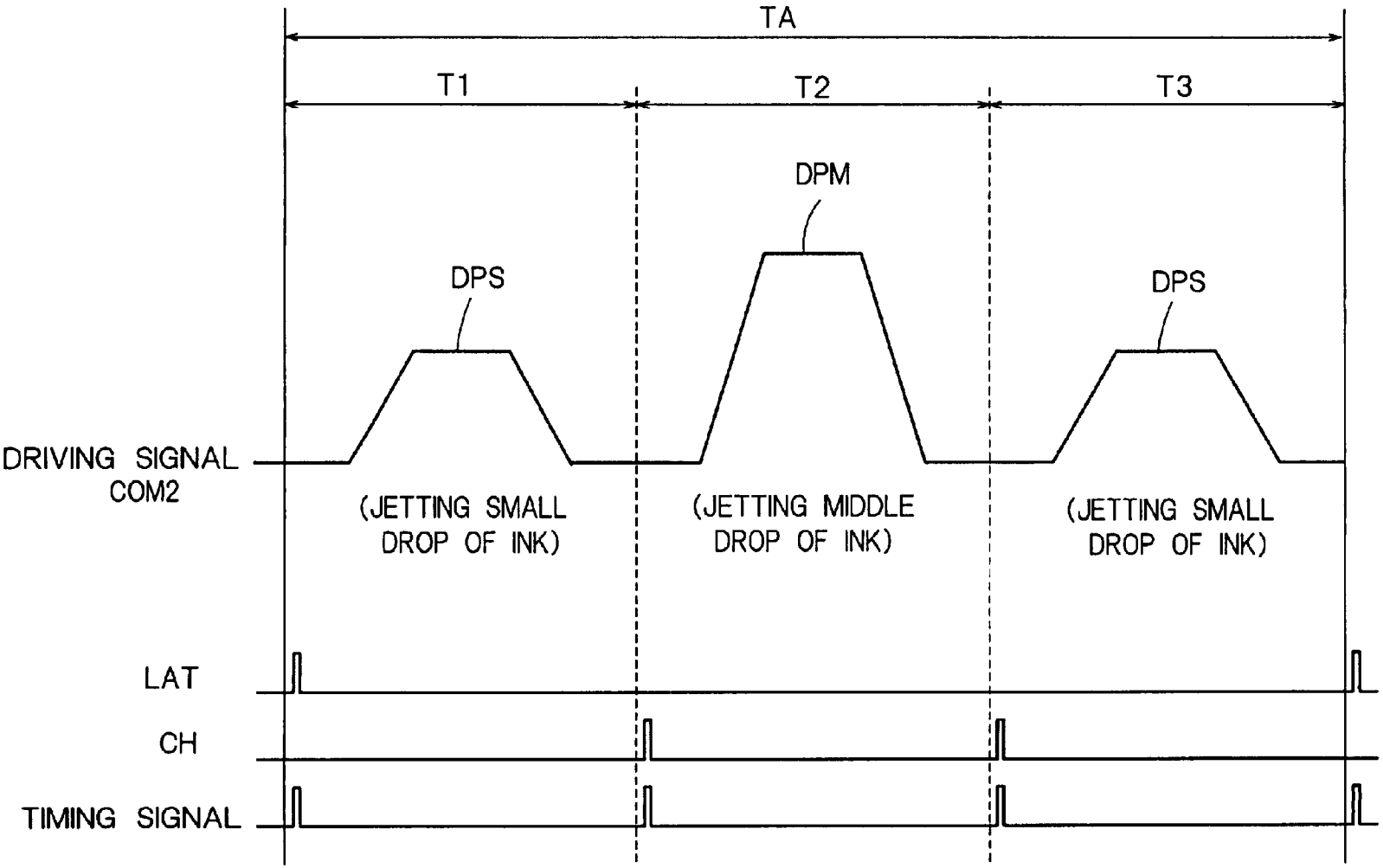
FIG. 16 is a diagram of another example of a driving signal.

For example, in a case of a driving signal COM2 shown in FIG. 16, a driving pulse DPS that can eject a small drop of the ink is arranged in a term T1, a driving pulse DPM that can eject a middle drop of the ink is arranged in a term T2, and another driving pulse DPS that can eject a small drop of the ink is arranged in a term T3.

In the case, when the driving pulse DPS is supplied to the piezoelectric vibrating member 15, a drop of the ink, whose volume corresponds to a small dot, is ejected from the nozzle 13. On the other hand, when the driving pulse DPM is supplied to the piezoelectric vibrating member 15, a drop of the ink, whose volume corresponds to a middle dot, is ejected from the nozzle 13.

Thus, a level control can be achieved by increasing or decreasing the number of the driving pulses supplied to the piezoelectric vibrating member 15. For example, when only one driving pulse DPS is supplied to the piezoelectric vibrating member, a small dot recording is achieved. When only one driving pulse DPM is supplied to the piezoelectric vibrating member, a middle dot recording is achieved. When the three driving pulses are supplied to the piezoelectric vibrating member, a large dot recording is achieved.

Even if the above driving signal COM2 is used, the effect of the invention can be sufficiently achieved, that is, generation of a gap line that can be perceived at an edge portion can be restrained much effectively.

Figure 17:
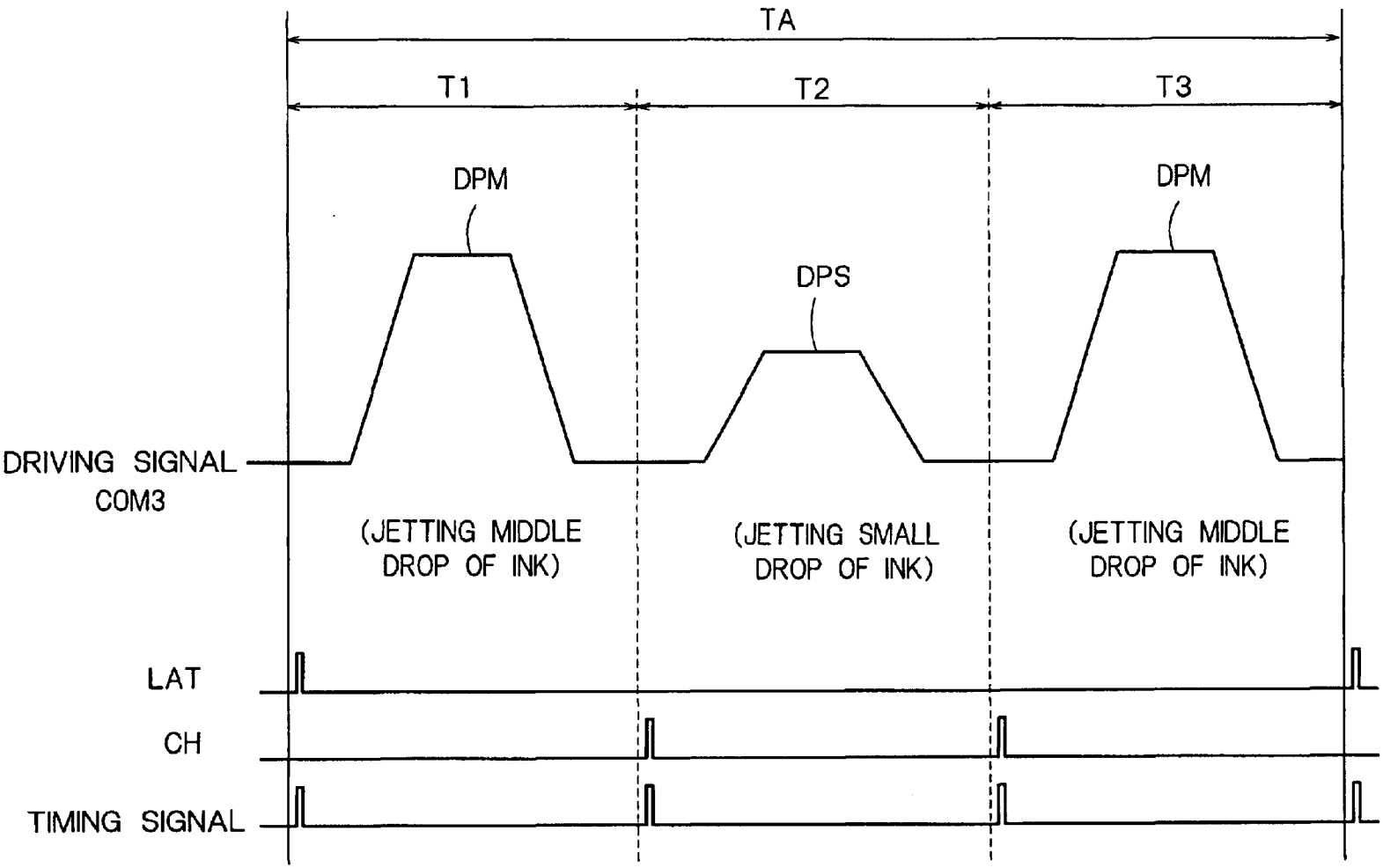
FIG. 17 is a diagram of another example of a driving signal.
Figure 18:
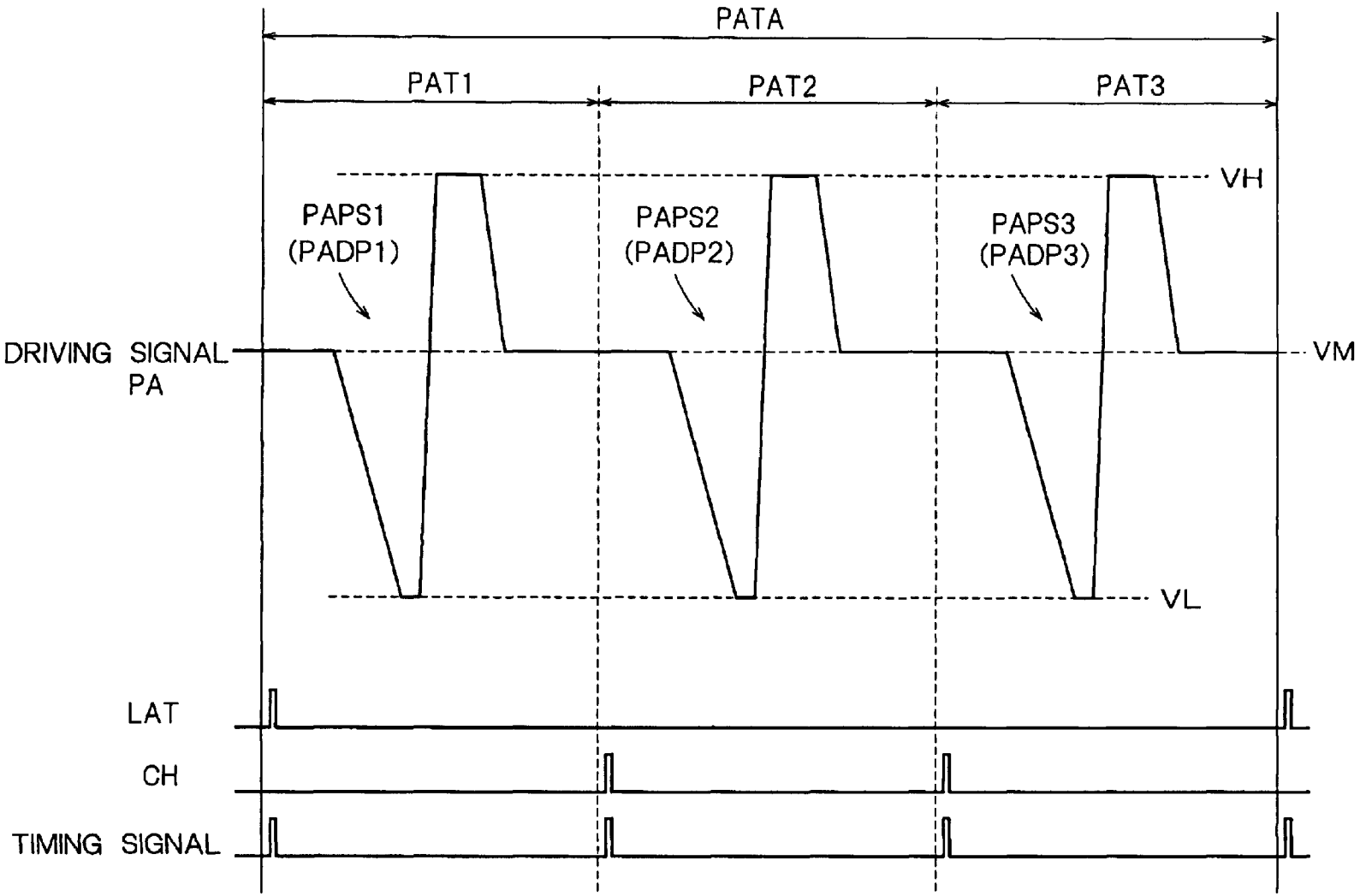
FIG. 18 is a diagram of an example of a conventional driving signal.
Figure 19:
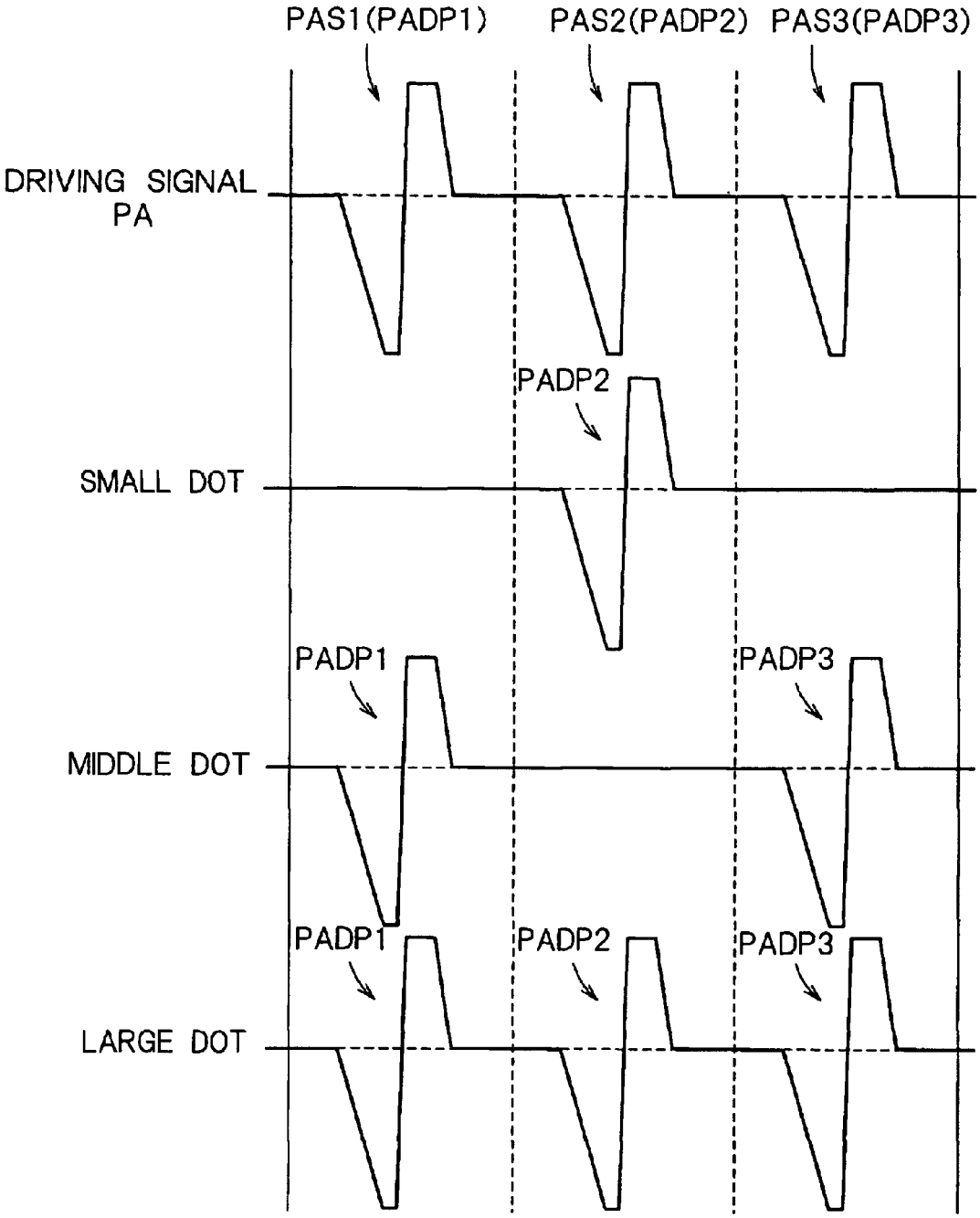
FIG. 19 is diagrams for explaining driving pulses generated based on the driving signal of FIG. 18.

Furthermore, in a case of a driving signal COM3 shown in FIG. 17, a driving pulse DPM that can eject a middle drop of the ink is arranged in a term T1, a driving pulse DPS that can eject a small drop of the ink is arranged in a term T2, and another driving pulse DPM that can eject a middle drop of the ink is arranged in a term T3.

Even if the above driving signal COM3 is used, the effect of the invention can be sufficiently achieved, that is, generation of a gap line that can be perceived at an edge portion can be restrained much effectively.

In addition, in the above driving signals COM to COM3, the small drop of the ink ejected from the nozzle according to the first small-dot pulse-wave and the small drop of the ink ejected from the nozzle according to the second small-dot pulse-wave have the same volume. This condition is a preferable one in carrying out this invention. However, it is not intended to exclude manners not satisfying this condition at a time of filing this application.

A pressure-generating unit for causing the volume of the pressure chamber 16 to change is not limited to the piezoelectric vibrating member 15. For example, a pressure-changing unit can consist of a magnetic distortion (magnetostrictive) device. In the case, the magnetic distortion device causes the pressure chamber 16 to expand and contract, thus, causes the pressure of the ink in the pressure chamber 16 to change. Alternatively, a pressure-changing unit can consist of a heating device. In the case, the heating device causes an air bubble in the pressure chamber 16 to expand and contract, thus, causes the pressure of the ink in the pressure chamber 16 to change.

As described above, the printer controller 1 can be materialized by a computer system. A program for materializing the above one or more components in a computer system, and a storage medium 201 storing the program and capable of being read by a computer, are intended to be protected by this application.

In addition, when the above one or more components may be materialized in a computer system by using a general program such as an OS that can operate in the computer system, a program including a command or commands for controlling the general program such as an OS, and a storage medium 202 storing the program, are also intended to be protected by this application.

Each of the storage medium 201 and 202 can be not only a substantial object such as a floppy disk or the like, but also a network for transmitting various signals.

The above description is given for the ink-jetting recording apparatus. However, this invention is intended to be applied to general liquid ejecting apparatuses widely. A liquid may be glue, nail polish or the like, instead of the ink. In addition, this invention can be also applied to a manufacturing unit for color filters in a display such as a liquid crystal display.

What is claimed is:

1. A liquid ejecting apparatus comprising a head having a nozzle, a main scanning unit that causes the head member to move in a main scanning direction relatively to a recording medium, a pressure-changing unit that causes pressure of liquid in the nozzle to change, a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data, the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

2. A liquid ejecting apparatus according to claim 1, wherein:

the small drop of the liquid ejected from the nozzle according to the first small-dot pulse-wave has the same volume as the small drop of the liquid ejected from the nozzle according to the second small-dot pulse-wave.

3. A liquid ejecting apparatus according to claim 1, wherein:

the plurality of level data further include a high-density level data, the level-data setting unit is adapted to set the high-density level data based on each of the ejecting-sequential data, and the driving-pulse generator is adapted to generate a driving-pulse including at least the third pulse-wave when the selected level data is the high-density level data, based on the ejecting-driving signal.

4. A liquid ejecting apparatus according to claim 1, further comprising a sub scanning unit that causes the head member to move in a sub scanning direction perpendicular to the main scanning direction relatively to the recording medium, wherein the row of the ejecting data includes a longitudinal edge data adjacent to the continuous area of level data of relatively high density in the sub scanning direction, and the level-data setting unit is adapted to set the first low-density level data or the second low-density level data based on the longitudinal edge data.

5. A liquid ejecting apparatus according to claim 4, wherein:

when only two longitudinal edge data are serial in the main scanning direction, the level-data setting unit is adapted to set the first low-density level data based on the former longitudinal edge data, and to set the second low-density level data based on the latter longitudinal edge data.

6. A liquid ejecting apparatus according to claim 4, wherein:

when an even number of longitudinal edge data are serial in the main scanning direction, the level-data setting unit is adapted to set the first low-density level data based on each of former half of the longitudinal edge data, and to set the second low-density level data based on each of latter half of the longitudinal edge data.

7. A liquid ejecting apparatus according to claim 4, wherein:

the plurality of level data further include a zero level data that corresponds to non-ejecting of the liquid, the driving-pulse generator is adapted to generate a driving-pulse not including any pulse-wave that is for ejecting a drop of the liquid when the selected level data is the zero level data, based on the ejecting-driving signal, and the level-data setting unit is adapted to set the first low-density level data, the second low-density level data or the zero level data, based on the longitudinal edge data.

8. A liquid ejecting apparatus according to claim 7, wherein:

when only three longitudinal edge data are serial in the main scanning direction, the level-data setting unit is adapted to set the first low-density level data based on the former longitudinal edge data, to set the zero level data based on the central longitudinal edge data, and to set the second low-density level data based on the latter longitudinal edge data.

9. A liquid ejecting apparatus according to claim 7, wherein:

when an odd number of longitudinal edge data are serial in the main scanning direction, the level-data setting unit is adapted to set the zero level data based on the central longitudinal edge data, to set the first low-density level data based on each of former longitudinal edge data with respect to the central longitudinal edge data, and to set the second low-density level data based on each of latter longitudinal edge data with respect to the central longitudinal edge data.

10. A liquid ejecting apparatus according to claim 7, wherein:

when only two longitudinal edge data are serial in the main scanning direction, the level-data setting unit is adapted to select one from the former longitudinal edge data and the latter longitudinal edge data, if the level-data setting unit selects the former longitudinal edge data, the level-data setting unit is adapted to set the first low-density level data based on the former longitudinal edge data, if the level-data setting unit selects the latter longitudinal edge data, the level-data setting unit is adapted to set the second low-density level data based on the latter longitudinal edge data, and the level-data setting unit is adapted to set the zero level data based on the unselected one of the former longitudinal edge data and the latter longitudinal edge data.

11. A liquid ejecting apparatus according to claim 7, wherein:

when an even number of longitudinal edge data are serial in the main scanning direction, the level-data setting unit is adapted to select one from the central two of the longitudinal edge data, if the level-data setting unit selects the former longitudinal edge data from the central two longitudinal edge data, the level-data setting unit is adapted to set the first low-density level data based on the former longitudinal edge data, if the level-data setting unit selects the latter longitudinal edge data from the central two longitudinal edge data, the level-data setting unit is adapted to set the second low-density level data based on the latter longitudinal edge data, the level-data setting unit is adapted to set the zero level data based on the unselected one of the central two longitudinal edge data, and the level-data setting unit is adapted to set the first low-density level data based on each of former longitudinal edge data with respect to the central two longitudinal edge data, and to set the second low-density level data based on each of latter longitudinal edge data with respect to the central two longitudinal edge data.

12. A controlling unit for controlling a liquid ejecting apparatus including a head having a nozzle, a main scanning unit that causes the head member to move in a main scanning direction relatively to a recording medium, and a pressure-changing unit that causes pressure of liquid in the nozzle to change, comprising a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data, the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

13. A controlling unit according to claim 12, wherein:

the small drop of the liquid ejected from the nozzle according to the first small-dot pulse-wave has the same volume as the small drop of the liquid ejected from the nozzle according to the second small-dot pulse-wave.

14. A controlling unit according to claim 12, wherein:

the plurality of level data further include a high-density level data, the level-data setting unit is adapted to set the high-density level data based on each of the ejecting-sequential data, and the driving-pulse generator is adapted to generate a driving-pulse including at least the third pulse-wave when the selected level data is the high-density level data, based on the ejecting-driving signal.

15. A controlling unit according to claim 12, wherein:

the controlling unit is adapted to control a liquid ejecting apparatus further including a sub scanning unit that causes the head member to move in a sub scanning direction perpendicular to the main scanning direction relatively to the recording medium, the row of the ejecting data includes a longitudinal edge data adjacent to the continuous area of level data of relatively high density in the sub scanning direction, and the level-data setting unit is adapted to set the first low-density level data or the second low-density level data based on the longitudinal edge data.

16. A controlling unit according to claim 15, wherein:

when only two longitudinal edge data are serial in the main scanning direction, the level-data setting unit is adapted to set the first low-density level data based on the former longitudinal edge data, and to set the second low-density level data based on the latter longitudinal edge data.

17. A controlling unit according to claim 15, wherein:

when an even number of longitudinal edge data are serial in the main scanning direction, the level-data setting unit is adapted to set the first low-density level data based on each of former half of the longitudinal edge data, and to set the second low-density level data based on each of latter half of the longitudinal edge data.

18. A controlling unit according to claim 15, wherein:

the plurality of level data further include a zero level data that corresponds to non-ejecting of the liquid, the driving-pulse generator is adapted to generate a driving-pulse not including any pulse-wave that is for ejecting a drop of the liquid when the selected level data is the zero level data, based on the ejecting-driving signal, and the level-data setting unit is adapted to set the first low-density level data, the second low-density level data or the zero level data, based on the longitudinal edge data.

19. A controlling unit according to claim 18, wherein:

when only three longitudinal edge data are serial in the main scanning direction, the level-data setting unit is adapted to set the first low-density level data based on the former longitudinal edge data, to set the zero level data based on the central longitudinal edge data, and to set the second low-density level data based on the latter longitudinal edge data.

20. A controlling unit according to claim 18, wherein:

when an odd number of longitudinal edge data are serial in the main scanning direction, the level-data setting unit is adapted to set the zero level data based on the central longitudinal edge data, to set the first low-density level data based on each of former longitudinal edge data with respect to the central longitudinal edge data, and to set the second low-density level data based on each of latter longitudinal edge data with respect to the central longitudinal edge data.

21. A controlling unit according to claim 18, wherein:

when only two longitudinal edge data are serial in the main scanning direction, the level-data setting unit is adapted to select one from the former longitudinal edge data and the latter longitudinal edge data, if the level-data setting unit selects the former longitudinal edge data, the level-data setting unit is adapted to set the first low-density level data based on the former longitudinal edge data, if the level-data setting unit selects the latter longitudinal edge data, the level-data setting unit is adapted to set the second low-density level data based on the latter longitudinal edge data, and the level-data setting unit is adapted to set the zero level data based on the unselected one of the former longitudinal edge data and the latter longitudinal edge data.

22. A controlling unit according to claim 18, wherein:

when an even number of longitudinal edge data are serial in the main scanning direction, the level-data setting unit is adapted to select one from the central two of the longitudinal edge data, if the level-data setting unit selects the former longitudinal edge data from the central two longitudinal edge data, the level-data setting unit is adapted to set the first low-density level data based on the former longitudinal edge data, if the level-data setting unit selects the latter longitudinal edge data from the central two longitudinal edge data, the level-data setting unit is adapted to set the second low-density level data based on the latter longitudinal edge data, the level-data setting unit is adapted to set the zero level data based on the unselected one of the central two longitudinal edge data, and the level-data setting unit is adapted to set the first low-density level data based on each of former longitudinal edge data with respect to the central two longitudinal edge data, and to set the second low-density level data based on each of latter longitudinal edge data with respect to the central two longitudinal edge data.

23. A storage medium capable of being read by a computer, storing a program executed by a computer system including at least a computer in order to materialize a controlling unit in the computer system, the controlling unit controlling a liquid ejecting apparatus including a head having a nozzle, a main scanning unit that causes the head member to move in a main scanning direction relatively to a recording medium, and a pressure-changing unit that causes pressure of liquid in the nozzle to change, the controlling unit comprising a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data, the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

24. A storage unit capable of being read by a computer, storing a program including a command for controlling a second program operable in a computer system including at least a computer, the program being executed by the computer system to control the second program to materialize a controlling unit in the computer system, the controlling unit controlling a liquid ejecting apparatus including a head having a nozzle, a main scanning unit that causes the head member to move in a main scanning direction relatively to a recording medium, and a pressure-changing unit that causes pressure of liquid in the nozzle to change, the controlling unit comprising a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data, the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

25. A program executed by a computer system including at least a computer in order to materialize a controlling unit in the computer system, the controlling unit controlling a liquid ejecting apparatus including a head having a nozzle, a main scanning unit that causes the head member to move in a main scanning direction relatively to a recording medium, and a pressure-changing unit that causes pressure of liquid in the nozzle to change, the controlling unit comprising a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data, the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

26. A program including a command for controlling a second program operable in a computer system including at least a computer, the program being executed by the computer system to control the second program to materialize a controlling unit in the computer system, the controlling unit controlling a liquid ejecting apparatus including a head having a nozzle, a main scanning unit that causes the head member to move in a main scanning direction relatively to a recording medium, and a pressure-changing unit that causes pressure of liquid in the nozzle to change, the controlling unit comprising a level-data setting unit that sets a selected level data from a plurality of level data, based on each of ejecting data forming a row corresponding to a main scanning movement, a driving-signal generator that generates an ejecting-driving signal, a driving-pulse generator that generates a driving pulse based on the selected level data and the ejecting-driving signal, and a main controller that causes the pressure-changing unit to operate, based on the driving pulse, wherein the row of the ejecting data includes: ejecting-sequential data corresponding to a continuous area of level data of relatively high density; an anterior edge data preceding the continuous area; and a posterior edge data following the continuous area;

the level-data setting unit is adapted to set a selected level data of relatively high density based on each of the ejecting-sequential data, to set a selected level data of relatively low density based on the anterior edge data, and to set a selected level data of relatively low density based on the posterior edge data;

the ejecting-driving signal is a periodical signal including a plurality of pulse-waves, the driving-pulse generator is adapted to generate a rectangular-pulse row corresponding to a period of the ejecting-driving signal based on the selected level data, and generate an AND signal of the rectangular-pulse row and the ejecting-driving signal as the driving pulse, the plurality of level data include a first low-density level data and a second low-density level data, the level-data setting unit is adapted to set the first low-density level data based on the anterior edge data, and to set the second low-density level data based on the posterior edge data, the ejecting-driving signal is a periodical signal including: a first small-dot pulse-wave that is for ejecting a small drop of the liquid from the nozzle, a second small-dot pulse-wave that is for ejecting a small drop of the liquid from the nozzle, and a third pulse-wave arranged between the first small-dot pulse-wave and the second small-dot pulse-wave, in each period thereof, and the driving-pulse generator is adapted to generate, based on the ejecting-driving signal:

a driving-pulse including only the second small-dot pulse-wave when the selected level data is the first low-density level data, and a driving-pulse including only the first small-dot pulse-wave when the selected level data is the second low-density level data.

* * * * *